US011344096B2

(12) United States Patent
Hantani

(10) Patent No.: US 11,344,096 B2
(45) Date of Patent: May 31, 2022

(54) TWEEZERS

(71) Applicant: SIMIAN LTD., Gujo (JP)

(72) Inventor: Shigeyuki Hantani, Gujo (JP)

(73) Assignee: SIMIAN LTD., Gujo (JP)

( * ) Notice: Subject to any disclaimer, the term of this patent is extended or adjusted under 35 U.S.C. 154(b) by 164 days.

(21) Appl. No.: 16/308,635

(22) PCT Filed: Jan. 23, 2018

(86) PCT No.: PCT/JP2018/001880
§ 371 (c)(1),
(2) Date: Dec. 10, 2018

(87) PCT Pub. No.: WO2019/053914
PCT Pub. Date: Mar. 21, 2019

(65) Prior Publication Data

US 2020/0315314 A1 Oct. 8, 2020

(30) Foreign Application Priority Data

Sep. 18, 2017 (JP) ..... JP2017-178446

(51) Int. Cl.
*A45D 26/00* (2006.01)

(52) U.S. Cl.
CPC ..... *A45D 26/0066* (2013.01)

(58) Field of Classification Search
CPC ..... A45D 26/0066; A45D 26/00; B25B 9/02; B25B 9/00; B25B 7/02; A61B 17/30;
(Continued)

(56) References Cited

U.S. PATENT DOCUMENTS 1,701,995 A * 2/1929 Anderson ..... A61B 17/30 606/210
2,653,048 A * 9/1953 Novak ..... B25B 9/02 294/99.2

(Continued)

FOREIGN PATENT DOCUMENTS

CN 204379431 U 6/2015
DE 100 01418 A1 8/2001

(Continued)

OTHER PUBLICATIONS

Notification of Reasons for Refusal dated Aug. 21, 2018, issued in counterpart of Japanese Patent Application No. 2017-178446, with English Translation. (11 pages).

(Continued)

*Primary Examiner* — Katherine H Schwiker
(74) *Attorney, Agent, or Firm* — Westerman, Hattori, Daniels & Adrian, LLP

(57) ABSTRACT

Tweezers 8 are provided with a pair of resilient gripping sections 80 and 81 and include an elliptic projection 85 restricting movement in a gripping direction provided on the inside in substantially the center in a longitudinal direction of the other-side gripping section 81. Preferably, a one-side gripping surface 80*a* of the one-side gripping section 80 is a plane, and the other-side gripping surface 81*a* of the other-side gripping section 81 is a reduction plane formed by cutting out a rear end side of an opposing plane symmetrically formed in the plane. The one-side gripping section 80 preferably includes a recess 80*c* in a direction in which a gripping interval narrows from a rear end side in a longitudinal direction toward a tip side. It is preferable that an engaging recess 81*c* be formed on an opposite side of the one-side gripping section 80 including the projection 85.

4 Claims, 31 Drawing Sheets

(58) Field of Classification Search
CPC ..... A61B 2017/305; A61B 2017/301; A61B 2017/303; A61B 2017/505; A61B 2017/2926; A61B 17/062; A61B 17/0483; A61B 17/2812; A61B 17/282; A61B 17/50
See application file for complete search history.

(56) References Cited

U.S. PATENT DOCUMENTS

| | | | | |
|---|---|---|---|---|
| 3,496,807 | A | 2/1970 | Jones et al. | |
| 3,815,609 | A * | 6/1974 | Chester | A61B 17/30 606/210 |
| 4,096,864 | A * | 6/1978 | Kletschka | A61B 17/30 604/35 |
| 4,461,297 | A | 7/1984 | Sutter | |
| 4,793,349 | A * | 12/1988 | Weinrib | A61B 17/062 606/148 |
| 4,938,214 | A * | 7/1990 | Specht | A61B 17/062 606/167 |
| 2009/0030448 | A1* | 1/2009 | Andre | A61B 17/30 606/205 |
| 2014/0276978 | A1* | 9/2014 | Shields | A61B 17/062 606/144 |
| 2015/0230884 | A1 | 8/2015 | McDonald et al. | |
| 2017/0348013 | A1* | 12/2017 | Mottola | A61B 17/22031 |

FOREIGN PATENT DOCUMENTS

| | | | |
|---|---|---|---|
| DE | 202 12 870 | U1 | 12/2002 |
| JP | 3056022 | U | 2/1999 |
| JP | 2008-93241 | A | 4/2008 |
| JP | 3178053 | U | 8/2012 |
| JP | 2015-150307 | A | 8/2015 |
| WO | 2014/047440 | A1 | 3/2014 |
| WO | 2017/183442 | A1 | 10/2017 |

OTHER PUBLICATIONS

Extended (Supplementary) European Search Report dated Aug. 4, 2021, issued in counterpart EP Application No. 18856153.4. (10 pages).
Office Action dated Dec. 1, 2021, issued in counterpart CN application No. 201880043196.9, with English translation. (14 pages).

* cited by examiner

TWEEZERS

TECHNICAL FIELD

The present invention relates to tweezers. The present invention more specifically relates to tweezers capable of reliably gripping a short gripped object.

BACKGROUND ART

In the prior art, as tools for gripping a short gripped object, there are hair tweezers and thorn tweezers, for example. Hair tweezers 27 as tweezers shown in FIG. 14(*a*) have a bilaterally symmetrical V shape as a whole, include a pair of resilient gripping sections 10, 10 on its tip side, and have both gripping surfaces 10*a*, 10*a* constituted of opposing planes.

In this case, if the hair tweezers are lightly gripped, as shown in FIG. 14(*b*), both gripping surfaces come into contact with each other over the entire surface. However, in order to grip a gripped object, it is necessary to apply a certain amount of force, and as shown in FIG. 14(*c*), as gripping surface lower ends 10*k* are pressed against each other by gripping, the tip is opened by bending, and the gripping force is maximum at the lower end portion and becomes smaller as the tip is approached.

As shown in FIG. 15(*a*), when a long gripped object 93 is longer than the gripping surface 10*a*, a lower end of the gripped object 93 can be strongly pressed and gripped. On the other hand, as shown in FIG. 15(*b*), when the gripped object 93 is short and thus has a length not more than the length of the gripping surface 10*a*, a sufficient gripping force cannot be obtained. In addition, as shown in FIG. 15(*c*), in the case of a short hair 95 projecting from the skin 97, there may be a case where the hair 95 cannot be gripped due to bending.

In order to prevent the tip from being opened due to bending, in tweezers 29 shown in FIG. 16, gripping surfaces 90*a*, 90*a* are formed to be small. Although a degree of opening of the tip is small depending on bending occurring along with gripping, as shown in FIG. 16(*a*), the gripping surfaces are likely to be misaligned by bending due to gripping, which poses a problem in reliably gripping. In addition, depending on strength of gripping, as shown in FIG. 16(*b*), there is a possibility that the gripping surfaces are disengaged from each other.

Here, hair tweezers having a fine concavoconvex line on the gripping surface have been proposed (see, for example, Patent Literature 1).

According to the hair tweezers described in Patent Literature 1, a hair can be gripped without slipping across a slightly wide surface formed by a plurality of concavoconvex lines. The tweezers are suitable for gripping a rather long hair with the plurality of concavoconvex lines.

CITATIONS LIST

Patent Literature

Patent Literature 1: Japanese Utility Model Registration No. 3178053

SUMMARY OF INVENTION

Technical Problems

Since the tweezers of Patent Literature 1 have the plurality of concavoconvex lines, there is an effect of gripping a long hair over a wide range; however, a pressing force applied to each convexity and concavity weakens accordingly, and a gripping force as a whole becomes weak. Thus, the tweezers of Patent Literature 1 are not suitable for strongly gripping short hairs.

The present invention has been made to solve the above conventional problems, and an object of the present invention is to provide tweezers capable of reliably gripping a short gripped object with a simple structure.

Solutions to Problems

The present invention provides:

1. Tweezers having elasticity and including gripping sections including a one-side gripping section and the other-side gripping section. In the tweezers, a rear end of the other-side gripping surface of the other-side gripping section is located closer to a tip side of the tweezers than a rear end of a one-side gripping surface of the one-side gripping section, and a gripped object is gripped between the one-side gripping surface and the other-side gripping surface.

2. The tweezers according to 1, in which the one-side gripping surface is a plane, and the other-side gripping surface is a reduction plane formed by cutting out a rear end side of opposing plane symmetrically formed in the plane.

3. The tweezers according to 1 or 2, in which the other-side gripping surface has a length in a tip direction of 0.1 mm to 1 mm.

4. The tweezers according to any one of 1 to 3, in which a projection restricting movement in a gripping direction is provided on the inside in substantially the center in a longitudinal direction of the one-side gripping section and/or the other-side gripping section.

5. The tweezers according to any one of 1 to 4, in which the one-side gripping section and/or the other-side gripping section includes an inclined plane and/or a recess in a direction in which a gripping interval narrows from a rear end side in a longitudinal direction toward a tip side.

6. The tweezers according to 5, in which the recess is formed closer to the tip side than the projection.

7. The tweezers according to any one of 4 to 6, in which an engaging recess to be engaged with the projection is formed on an opposite side of the gripping section including the projection.

8. The tweezers according to any one of 1 to 7, in which a tip front surface of the one-side gripping section or the other-side gripping section is formed in a flat plate shape.

9. Tweezers having elasticity and including gripping sections comprising a one-side gripping section and the other-side gripping section, in which a projection restricting movement in a gripping direction is provided on the inside in substantially the center in a longitudinal direction of the one-side gripping section and/or the other-side gripping section.

10. The tweezers according to any one of 1 to 9, which are hair tweezers, thorn tweezers, or fishbone tweezers.

Advantageous Effects of Invention

1. In the tweezers according to the invention of claim 1, the rear end of the other-side gripping surface is located closer to the tip side of the tweezers than the rear end of the one-side gripping surface, so that a short gripped object can be reliably gripped.

2. In the tweezers according to the invention of claim 2, the one-side gripping surface is a plane, and the other-side gripping surface is a reduction plane formed by cutting out the rear end side of the opposing plane, so that even if the gripping section bends, a short gripped object can be reliably gripped.

3. In the tweezers according to the invention of claim 3, the other-side gripping surface has a length in the tip direction of 0.1 mm to 1 mm in the tweezers according to claim 1 or 2, so that a short gripped object can be more reliably gripped.

4. In the tweezers according to the invention of claim 4, the projection restricting movement in the gripping direction is provided on the inside in substantially the center in the longitudinal direction of the one-side gripping section and/or the other-side gripping section in the tweezers according to any one of claims 1 to 3; therefore, gripping is performed with a weak force at a portion where the gripping force is not required so much, and a strong force can be applied at a portion where a large gripping force is required.

5. In the tweezers according to the invention of claim 5, the one-side gripping section and/or the other-side gripping section includes the inclined plane and/or the recess in the direction in which the gripping interval narrows from the rear end side in the longitudinal direction toward the tip side in the tweezers according to any one of claims 1 to 4, so that the tweezers are easily gripped with fingers.

6. In the tweezers according to the invention of claim 6, since the recess is formed closer to the tip side than the projection in the tweezers according to claim 5, a force can be easily applied to the tip portion with fingers with a portion where the projection is formed as a fulcrum.

7. In the tweezers according to the invention of claim 7, since the engaging recess to be engaged with the projection is formed on the opposite side of the gripping section including the projection in the tweezers according to any one of claims 4 to 6, the projection is fixed by gripping, and a misalignment between the tip portions of the gripping sections can be prevented.

8. In the tweezers according to the invention of claim 8, since the tip front surface of the one-side gripping section is formed in a flat plate shape in the tweezers according to any one of claims 1 to 7, there is no possibility of breaking a gripped object due to a planar abutment against the gripped object.

9. The tweezers according to the invention of claim 9 are tweezers including a pair of resilient gripping sections, and a projection restricting movement in a gripping direction is provided on the inside in substantially the center in a longitudinal direction of a one-side gripping section and/or the other-side gripping section; therefore, gripping is performed with a small force until an inside of the gripping section is abutted against the projection, and after the inside of the gripping section is abutted against the projection, a large force can be applied with the projection as a fulcrum.

10. In the tweezers according to the invention of claim 10, since the tweezers according to any one of claims 1 to 9 are hair tweezers, thorn tweezers, or fishbone tweezers, this is particularly effective for a short gripped object.

DESCRIPTION OF EMBODIMENTS

Figure 1:
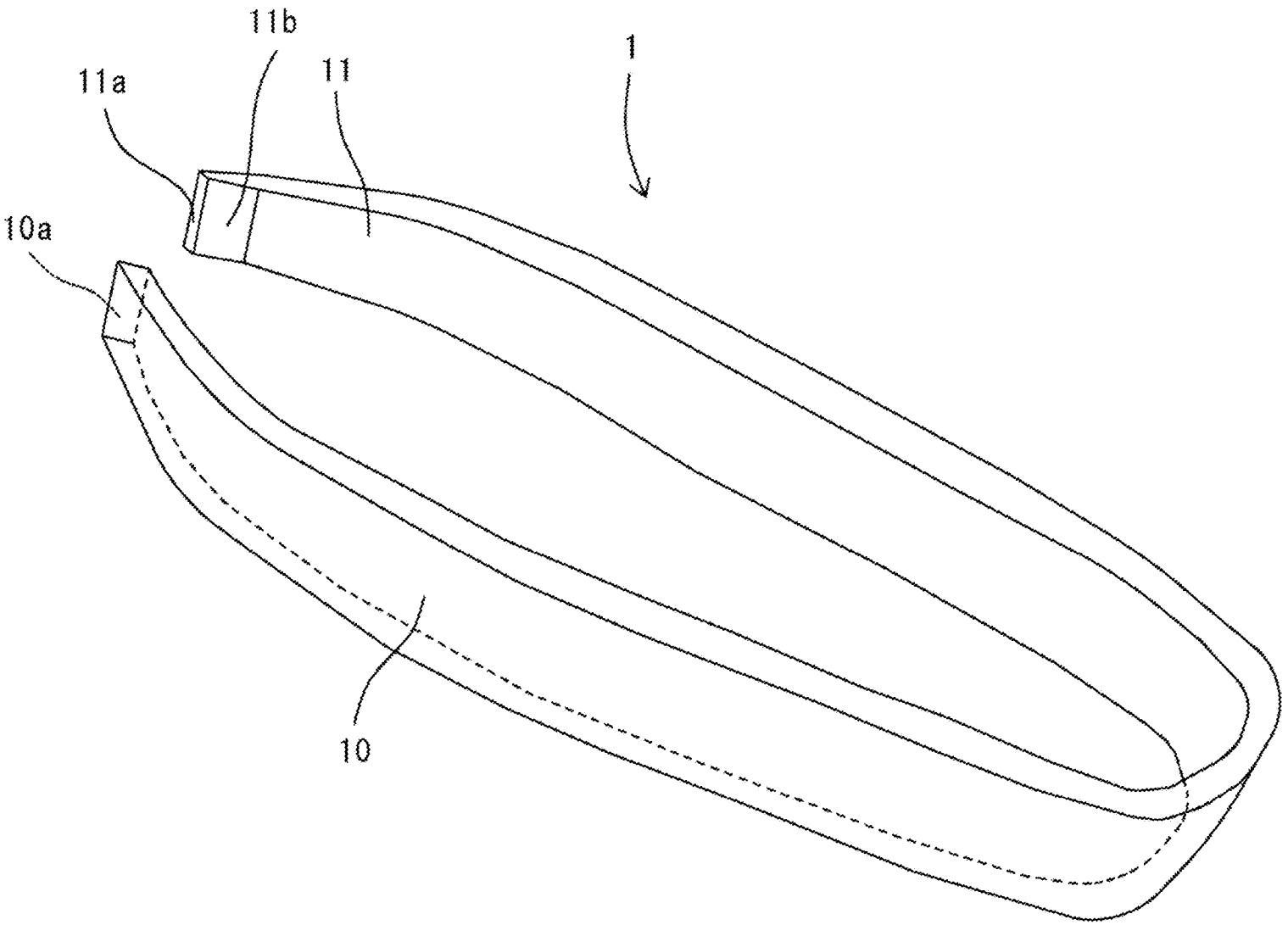
FIG. 1 is a schematic perspective view of tweezers according to Embodiment 1 of the present invention.

Hereinafter, the present invention will be described in detail with reference to the drawings. The present invention shall not be limited to the specific example of use shown in the drawing, but could be variously changed depending on the purpose and the use.

The "tweezers" of the present invention have a pair of gripping sections, can grip a gripped object with tips of the gripping sections, are not limited particularly as long as base end portions are connected or continuously provided, may have a ring annular shape, a square shape, a V shape, or a U shape as a whole, and may have a shape in which the gripping sections may be asymmetrical to the center in the longitudinal direction.

In the present invention, the term "cutout" means a cutout shape, and is not limited to the case of cutout processing in manufacturing.

Embodiment 1

Figure 2A:
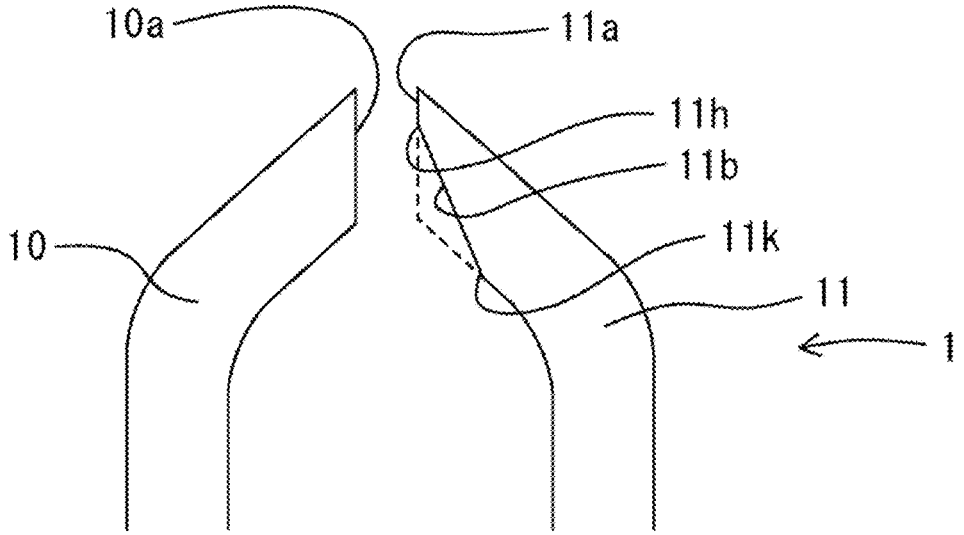
FIG. 2 is a front view showing a tip portion of the tweezers according to Embodiment 1, in which FIG. 2(*a*) shows a state in which gripping is not performed, FIG. 2(*b*) shows a state in which gripping sections are lightly brought into contact with each other, and FIG. 2(*c*) shows a state in which the gripping sections are strongly gripped and the tip is opened by bending.
Figure 2:
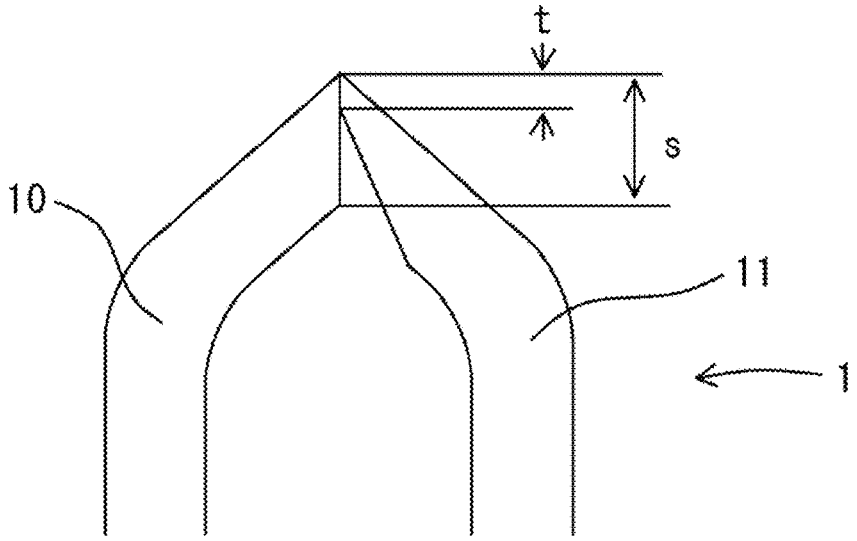
Figure 2:
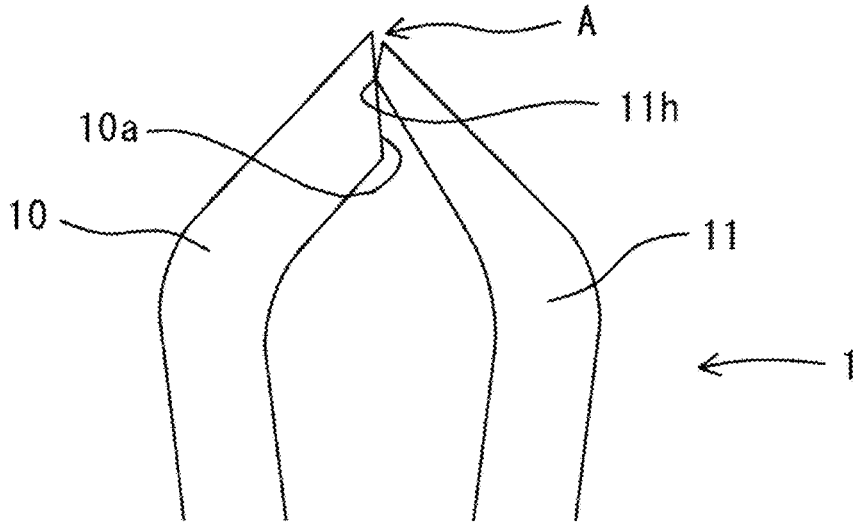

As shown in FIGS. 1 and 2, tweezers 1 according to Embodiment 1 have a substantially bilaterally symmetrical V shape as a whole and include a pair of resilient gripping sections 10 and 11 on the tip side.

A one-side gripping surface 10*a* is a plane, and the other-side gripping surface 11*a* is a reduction plane formed by cutting out a rear end side of opposing plane symmetrically formed in the plane. That is, as shown in FIG. 2(*a*), the other-side gripping surface 11*a* is formed by cutting out an opposing plane, formed plane-symmetrically with the one-side gripping surface 10*a* and indicated by a broken line, with a cutout plane 11*b* cut at an upper end 11*h* and a lower end 11*k*.

Although the cutout dimension is not particularly limited, as shown in FIG. 2(*b*), assuming that the lengths of the one-side gripping surface 10*a* and the other-side gripping surface 11*a* in the tip direction are s and t, respectively, s>t, and it is preferable that t=0.1 mm to 1 mm.

Thus, as shown in FIG. 2(*c*), when the gripping sections 10 and 11 are strongly gripped, the upper end 11*h* plays a role as a protrusion, and, at the same time, the opening A at the tip becomes small. For this reason, it is easy to grip a short gripped object.

Figure 3:
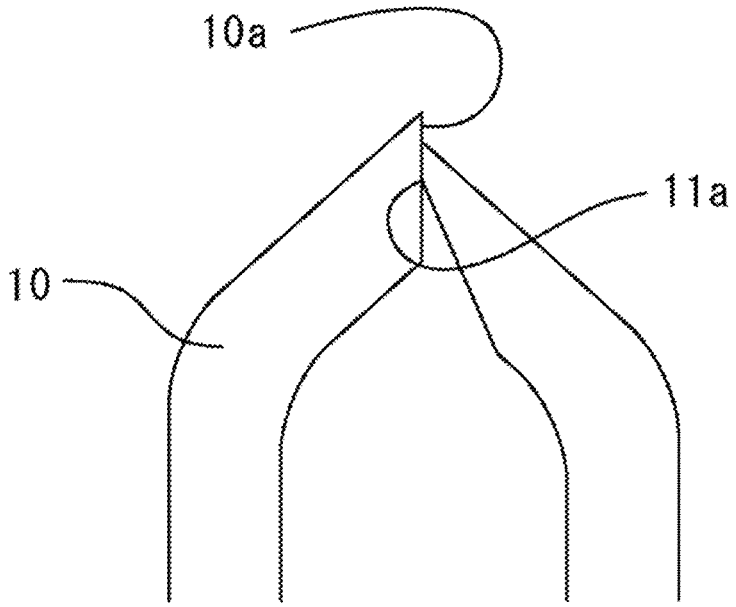
FIG. 3 is a front view showing the tip portion of the tweezers according to Embodiment 1, in which FIG. 3(*a*) shows a state in which the gripping sections are lightly gripped and a contact surface is misaligned, and FIG. 3(*b*) shows a state in which the gripping sections are somewhat strongly gripped and the contact surface is misaligned.
Figure 3:
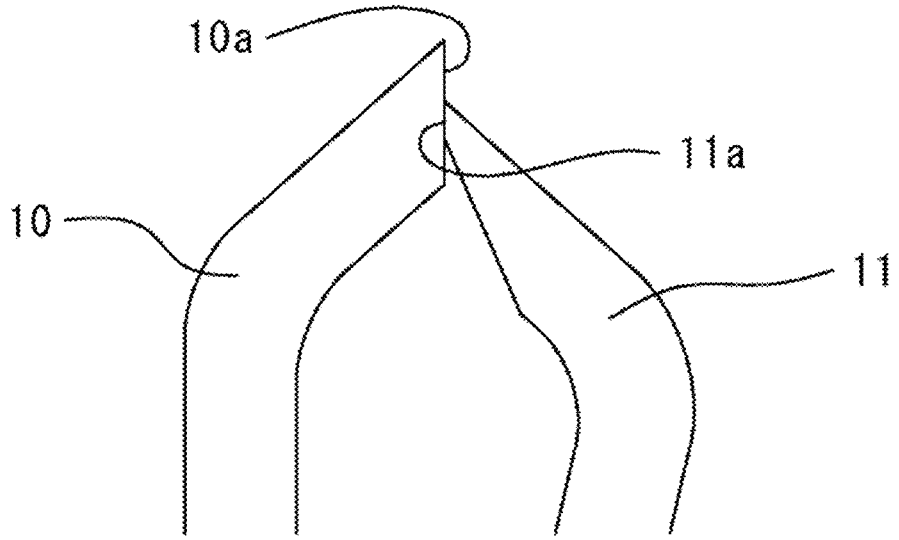

As shown in FIG. 3(*a*), even if the tips of the one-side gripping surface 10*a* and the other-side gripping surface 11*a* are misaligned during gripping, since the one-side gripping surface 10*a* is wide, the other-side gripping surface 11*a* is not disengaged from the one-side gripping surface 10*a*.

As shown in FIG. 3(*b*), even if the gripping sections 10 and 11 are bent by strong gripping, the other-side gripping surface 11*a* is not disengaged from the one-side gripping surface 10*a*.

Here, the tweezers of the present invention are not limited to Embodiment 1, and as long as the rear end of the other-side gripping surface is located closer to the tip side of the tweezers than the rear end of the one-side gripping surface, the shapes of the other portions are not particularly limited and can be set suitably. This also applies to the other embodiments except for Embodiment 8. In Embodiment 8, the shape of the gripping surface is not particularly limited.

Embodiment 2

Figure 4:
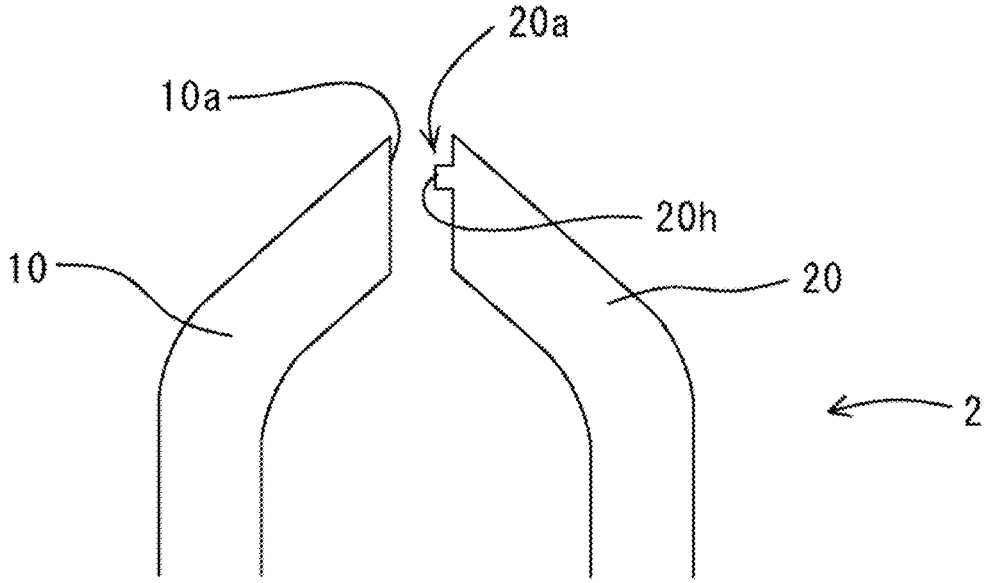
FIG. 4(*a*) is a front view showing a tip portion of tweezers according to Embodiment 2, FIG. 4(*b*) is a front view showing a tip portion of tweezers according to Embodiment 3, and FIG. 4(*c*) is a front view showing a tip portion of tweezers according to Embodiment 4.
Figure 4:
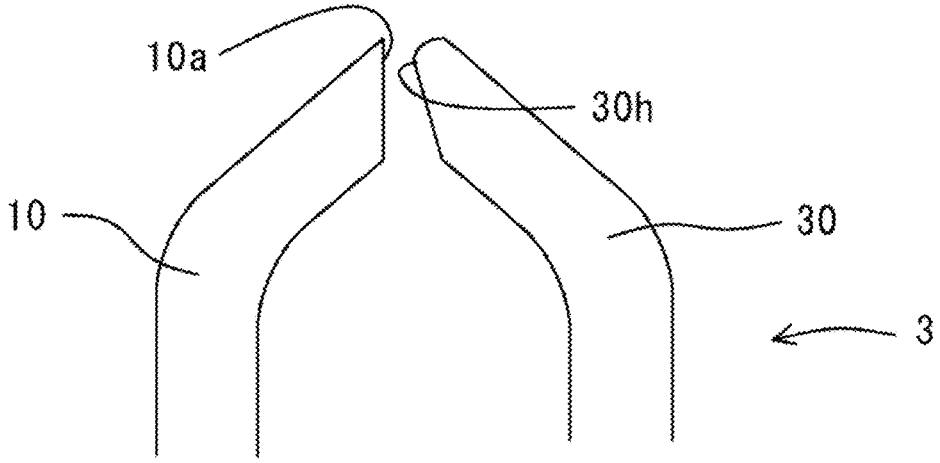
Figure 4:
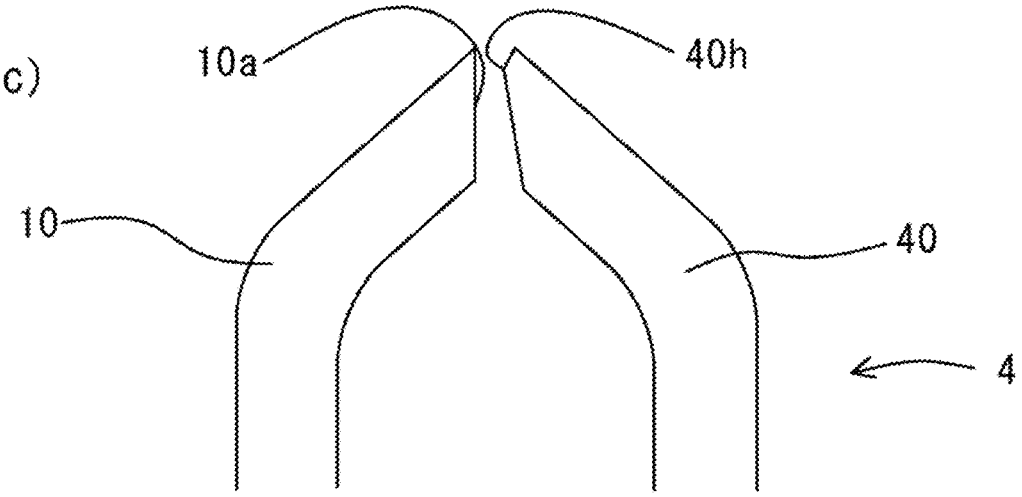

Tweezers 2 according to Embodiment 2 have a substantially bilaterally symmetrical V shape as a whole and, as shown in FIG. 4(*a*), include a pair of resilient gripping sections 10 and 20 on the tip side.

A one-side gripping surface 10*a* is a plane, and a rectangular parallelepiped protrusion 20*a* is formed orthogonal to a direction in which the other-side gripping surface bends. A gripped object can be gripped between a surface 20*h* of the protrusion and the one-side gripping surface 10*a*. Since the protrusion 20*a* is formed on an upper portion of the other-side gripping surface, even a short gripped object can be gripped.

Embodiment 3

Tweezers 3 according to Embodiment 3 have a substantially bilaterally symmetrical V shape as a whole and, as shown in FIG. 4(*b*), include a pair of resilient gripping sections 10 and 30 on the tip side.

A one-side gripping surface 10*a* is a plane, a tip side of the other-side gripping surface is formed in a curved convex shape, and a lower end of the curved portion is formed as a linear protrusion 30*h* orthogonal to a direction in which the gripping section 30 bends. A gripped object can be gripped between the protrusion 30*h* and the one-side gripping surface 10*a*. Since the protrusion 30*h* is formed on an upper portion of the other-side gripping surface, even a short gripped object can be gripped.

Embodiment 4

Tweezers 3 according to Embodiment 4 have a substantially bilaterally symmetrical V shape as a whole and, as shown in FIG. 4(*c*), include a pair of resilient gripping sections 10 and 40 on the tip side.

A one-side gripping surface 10*a* is a plane, and a linear protrusion 40*h* which protrudes in a mountain shape with respect to the one-side gripping surface 10*a* and is orthogonal in a direction in which the gripping section 40 bends is formed near a tip of the other-side gripping surface. A gripped object can be gripped between the protrusion 40*h* and the one-side gripping surface 10*a*. Since the protrusion 40*h* is formed on an upper portion of the other-side gripping surface, even a short gripped object can be gripped.

Embodiment 5

Figure 5:
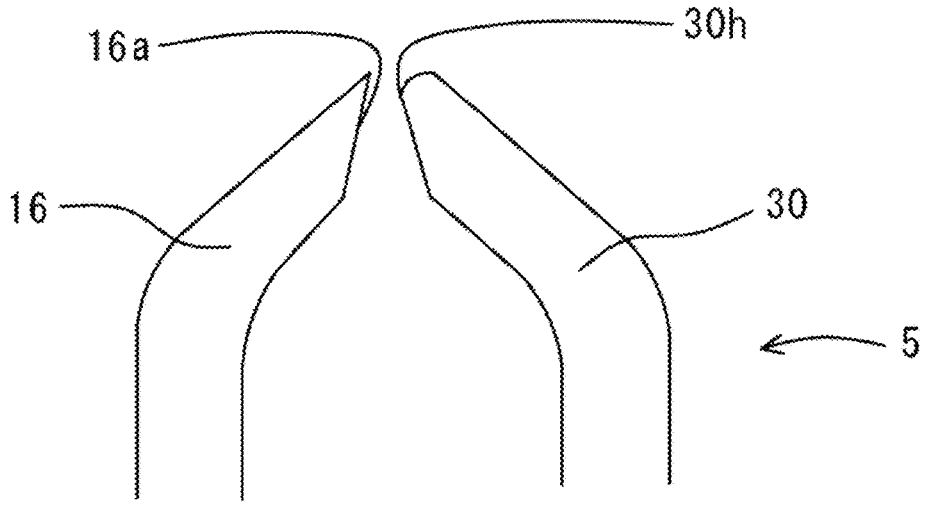
FIG. 5(*a*) is a front view showing a tip portion of tweezers according to Embodiment 5, FIG. 5(*b*) is a front view showing a tip portion of tweezers according to Embodiment 6, and FIG. 5(*c*) is a front view showing a tip portion of tweezers according to Embodiment 7.
Figure 5:
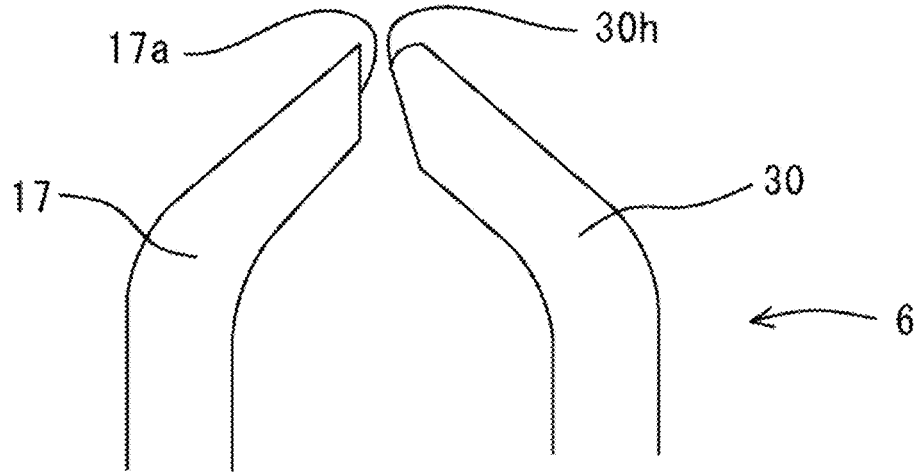
Figure 5:
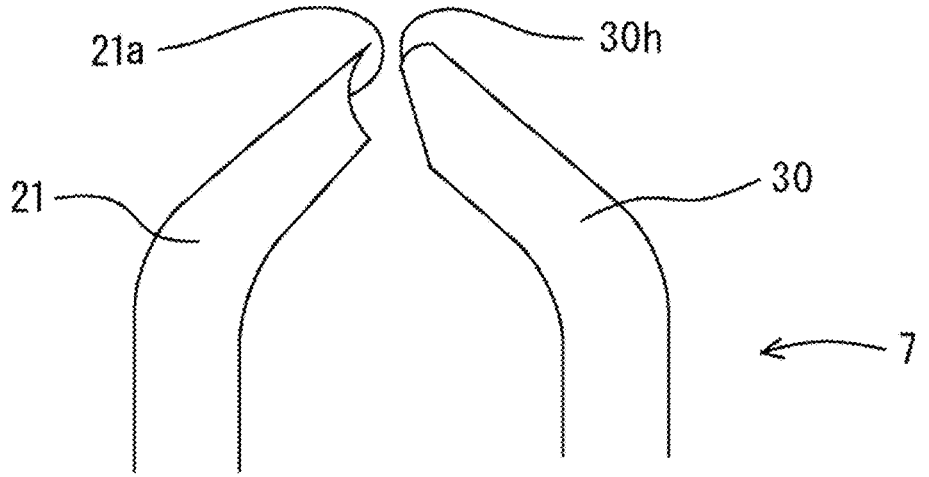

Tweezers 5 according to Embodiment 5 have a substantially bilaterally symmetrical V shape as a whole and, as shown in FIG. 5(*a*), include a pair of resilient gripping sections 16 and 30 on the tip side.

In Embodiment 3, a one-side gripping surface 16*a* is inclined obliquely leftward with respect to a symmetrical surface, and a gripped object can be gripped between the protrusion 30*h* and the one-side gripping surface 16*a*. In this case as well, the action and effect similar to those of Embodiment 3 can be obtained.

Embodiment 6

Tweezers 6 according to Embodiment 6 have a substantially bilaterally symmetrical V shape as a whole and, as shown in FIG. 5(*b*), include a pair of resilient gripping sections 17 and 30 on the tip side.

In Embodiment 3, a one-side gripping surface 17*a* is inclined obliquely rightward with respect to a symmetrical surface, and a gripped object can be gripped between the protrusion 30*h* and the one-side gripping surface 17*a*. In this case as well, the action and effect similar to those of Embodiment 3 can be obtained.

Embodiment 7

Tweezers 7 according to Embodiment 7 have a substantially bilaterally symmetrical V shape as a whole and, as shown in FIG. 5(*c*), include a pair of resilient gripping sections 21 and 30 on the tip side.

In Embodiment 3, a one-side gripping surface 21*a* forms a curved concave surface with respect to a symmetrical surface, and a gripped object is gripped between the curved concave surface as the one-side gripping surface 21*a* and the protrusion 30*h*. In this case as well, the action and effect similar to those of Embodiment 3 can be obtained.

Even when a curved convex surface is formed instead of the curved concave surface, the gripped object can be gripped between the curved convex surface and the protrusion 30*h*, and in this case as well, the action and effect similar to those of Embodiment 3 can be obtained.

Embodiment 8

Figure 6:
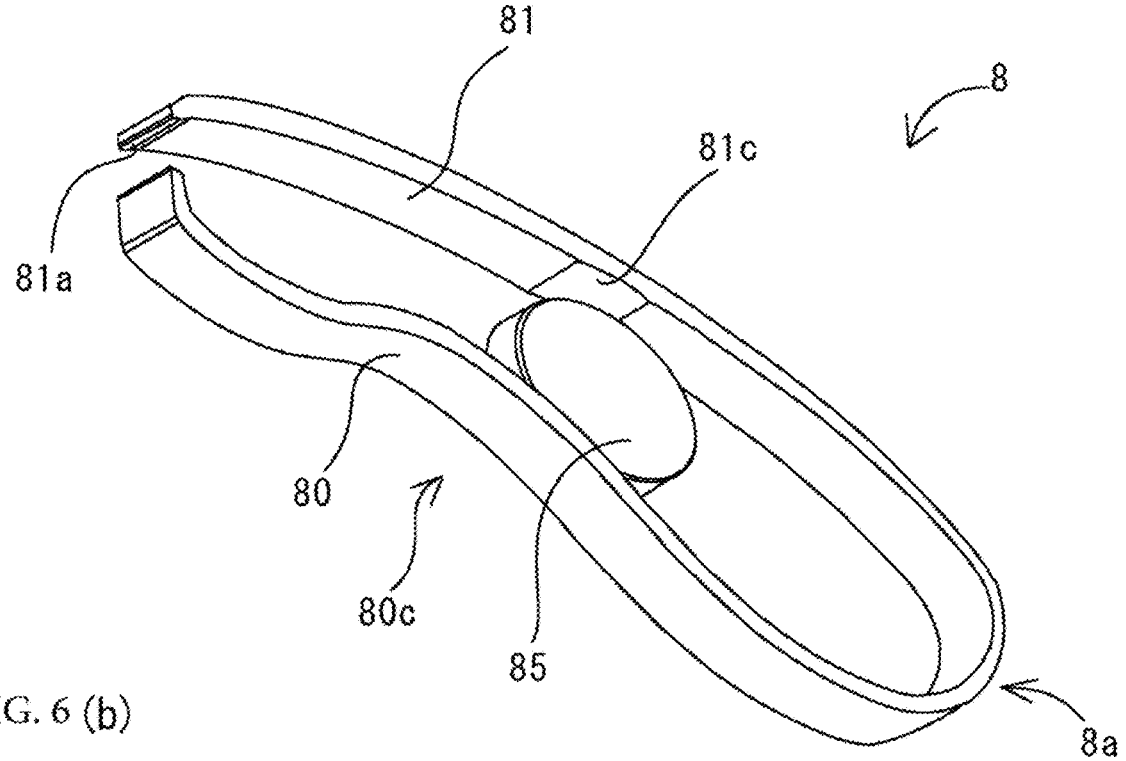
FIG. 6(*a*) is a schematic perspective view of tweezers according to Embodiment 8 as viewed from below, and FIG. 6(*b*) is a schematic perspective view of the tweezers according to Embodiment 8 as viewed from above.
Figure 6:
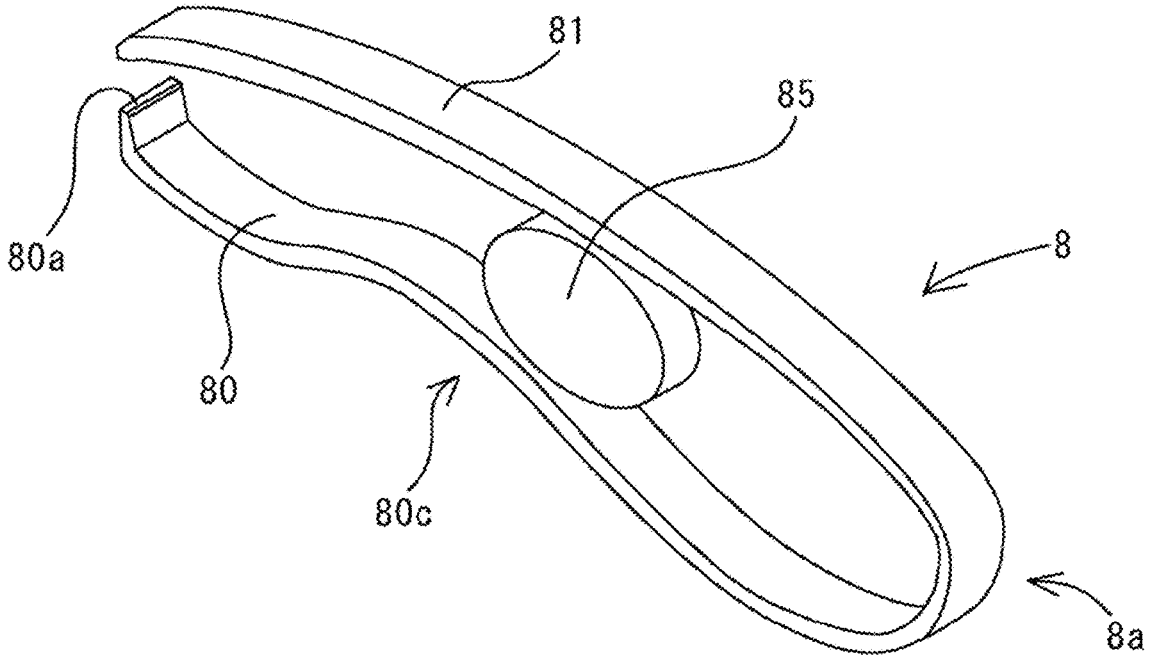

As shown in FIG. 6, tweezers 8 according to Embodiment 8 are tweezers including a pair of resilient gripping sections 80 and 81 and include an elliptic projection 85 restricting movement in a gripping direction provided on the inside in substantially the center in a longitudinal direction of the other-side gripping section 81. The projection may be provided on either one or both of one-side gripping section and the other-side gripping section.

The shape of the projection is not particularly limited and may be a precise circular shape, a polygonal shape, a semicircular shape, a semi-cylindrical shape, a prismatic shape, or the like.

The one-side gripping section 80 includes a recess 80*c* in a direction in which a gripping interval narrows from the rear end side in the longitudinal direction toward the tip side. Consequently, the whole shape is adapted to the shape of the fingers in a state of usual holding, and therefore easy gripping can be achieved.

The shape is not limited to the shape of the recess and may be a shape having an inclined plane.

It is preferable that the vicinity of a base end portion 8*a* be formed thin. This enables gripping with a small force.

Figure 7:
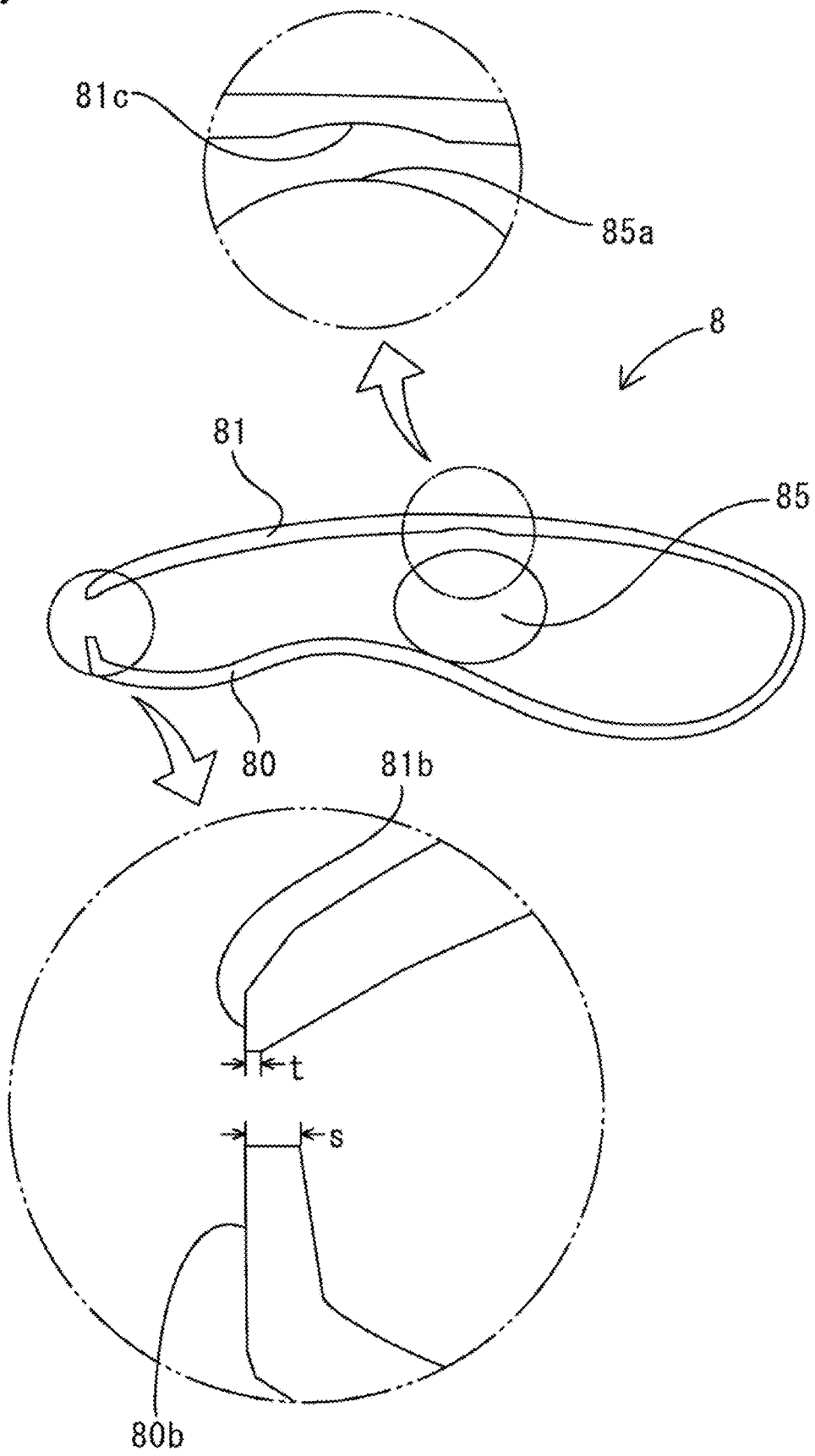
FIG. 7 is an enlarged view of a tip portion of the tweezers and the vicinity of an engaging recess according to Embodiment 8.

In addition, preferably, while one-side gripping surface 80*a* is a plane, the other-side gripping surface 81*a* is a reduction plane formed by cutting out a rear end side of opposing plane symmetrically formed in the plane, and a gripped object is gripped between the one-side gripping surface 80*a* and the other-side gripping surface 81*a*. Although the cutout dimension is not particularly limited, as shown in FIG. 7, assuming that the lengths of the one-side gripping surface 80*a* and the other-side gripping surface 81*a* in the tip direction are s and t, respectively, s>t, and when the tweezers 6 are hair tweezers, it is preferable that t=0.1 mm to 1 mm. In cases other than hair tweezers, the length t in the tip direction can be appropriately determined depending on the purpose and application. The operational advantage thereof is the same as that of Embodiment 1, and the description thereof will be omitted.

It is preferable that the recess 80*c* be formed closer to the tip side than the projection 85. Consequently, a force can be easily applied to the tip portion with fingers with a portion where the projection 85 is formed as a fulcrum.

In addition, it is preferable that an engaging recess 81*c* to be engaged with the projection 85 be formed on an opposite side of the gripping section 80 including the projection 85. The projection 85 is fixed by gripping, and a misalignment between the tip portions of the gripping sections can be prevented. Especially in tweezers formed of a soft material, since the misalignment is liable to occur, the effect of forming the engaging recess 81*c* is large.

It is preferable that a tip front surface 80*b* of the one-side gripping section 80 be formed in a flat plate shape. Consequently, there is no possibility of breaking a gripped object (skin) due to a planar abutment against the gripped object.

Since the gripping section 80 comes into contact with the skin from the near side in use of the tweezers 8, a soft touch can be realized.

The tip front surface 81*b* of the other-side gripping section 81 is an ordinary plane, so that a sense of safety can be achieved so as not to reduce visibility.

(Actions)

The actions of the tweezers 8 will be described below with reference to FIG. 8, taking as an example a case where the tweezers 8 are hair tweezers.

When the short hair 95 is removed from the skin 97, the thumb is abutted against the recess 80*c* of the gripping section 80 of the tweezers 8, and the index finger is abutted against an upper surface of the gripping section 81, whereby the tweezers 8 are held.

Figure 8:
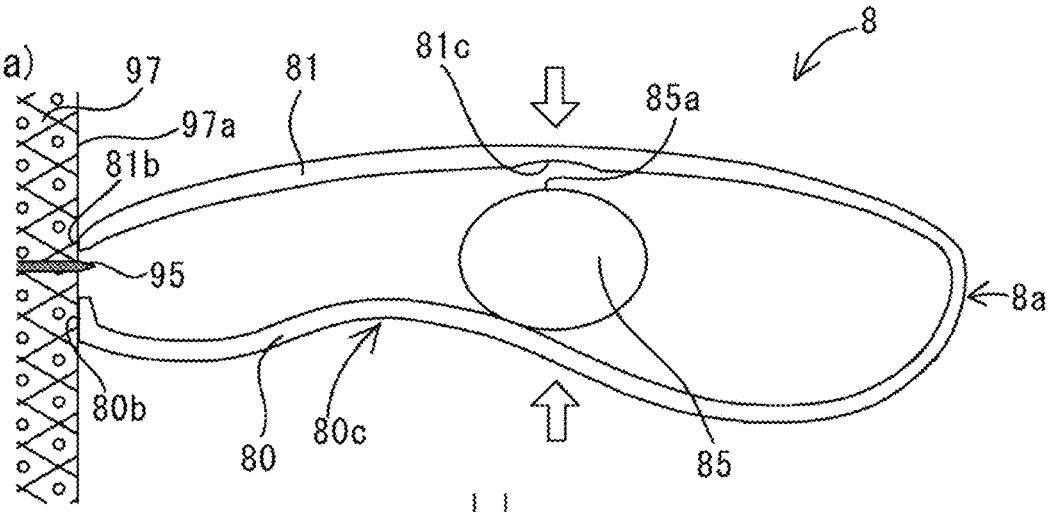
FIG. 8(*a*) is a front view of the tweezers according to Embodiment 8 showing a state before a gripped object is gripped, FIG. 8(*b*) is a front view thereof showing a state in which the gripped object is gripped, and FIG. 8(*c*) is a front view showing a state in which the gripped object is pressed and gripped.
Figure 8:
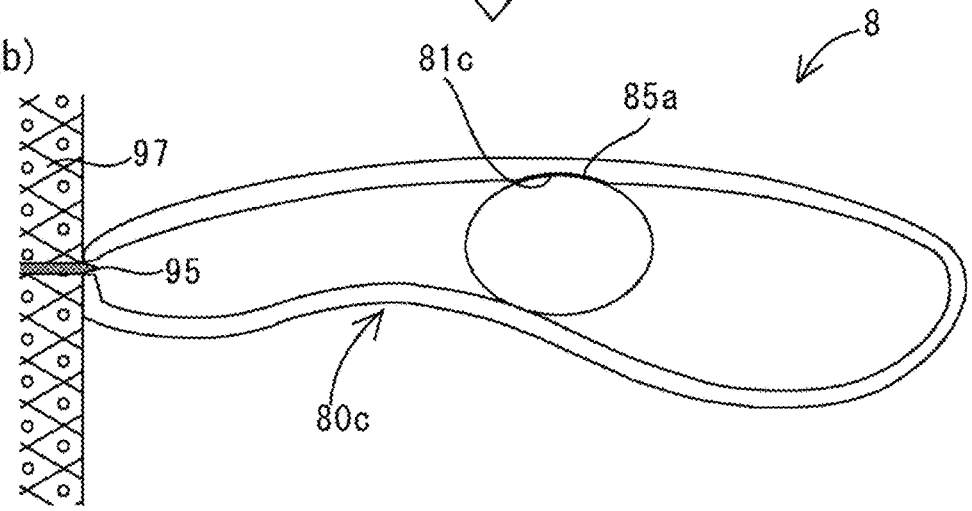
Figure 8:
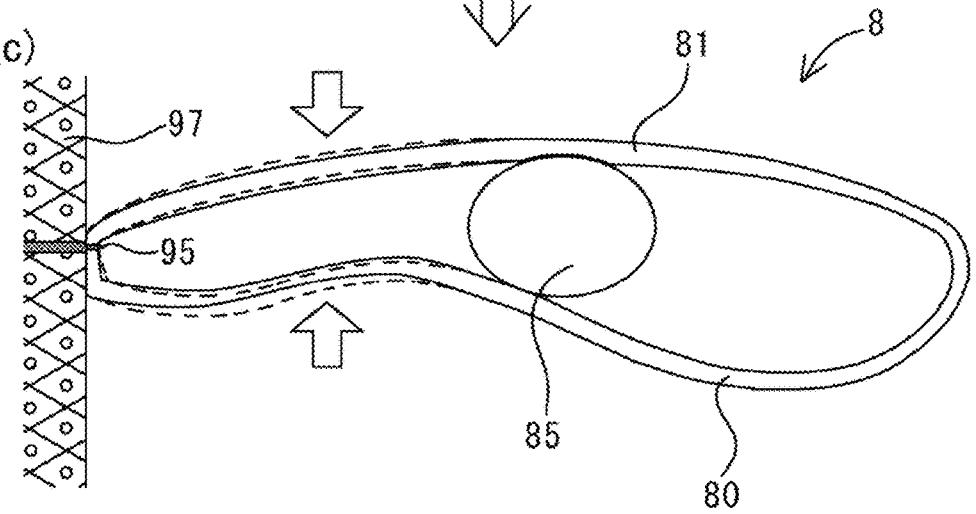

Then, as shown in FIG. 8(*a*), the tip front surfaces 80*b* and 81*b* of the gripping sections 80 and 81 are abutted against a surface 97*a* of the skin 97 so as to surround the hair 95.

Subsequently, as shown in FIG. 8(*b*), the tweezers 19 are gripped until an upper portion 85*a* of the projection 85 is engaged with the engaging recess 81. At this time, since the vicinity of the base end portion 8*a* serving as a fulcrum is formed thin, the tweezers can be gripped with a small force. Here, preferably, the tip front surface 80*b* of the gripping section 80 is first abutted against the skin 97 and supported, and the hair 95 is then gripped by the gripping section 81. Since the tip front surface 80*b* has a flat plate shape, the gripping section 80 can be stabilized on the skin 97.

Then, as shown in FIG. 8(*c*), the hair 95 can be pressed and gripped by further gripping in the direction of the arrow with the projection 85 as a fulcrum. In this case, since the fulcrum is close to the tip side relative to the base end portion 8*a*, even if the pressing force is small, a large force can be applied to a tip gripping surface.

That is, it is possible to perform gripping as lightly as possible in a portion where a large force is unnecessary, and a large force for obtaining a gripping force can be applied as necessary.

As shown in FIG. 8(*b*), since a portion close to the tip portion is pressed with the projection 85 as a fulcrum, the tip portion is more easily pressed. Thus, it is possible to suppress slipping-out of a short gripped object due to opening of the tip.

Since a large force is easily applied to the tip portion, it can be said that even if tweezers are not formed of a material having a large elastic force, it is possible to maintain the effect of easily performing pressing and gripping.

Embodiment 9

Figure 9:
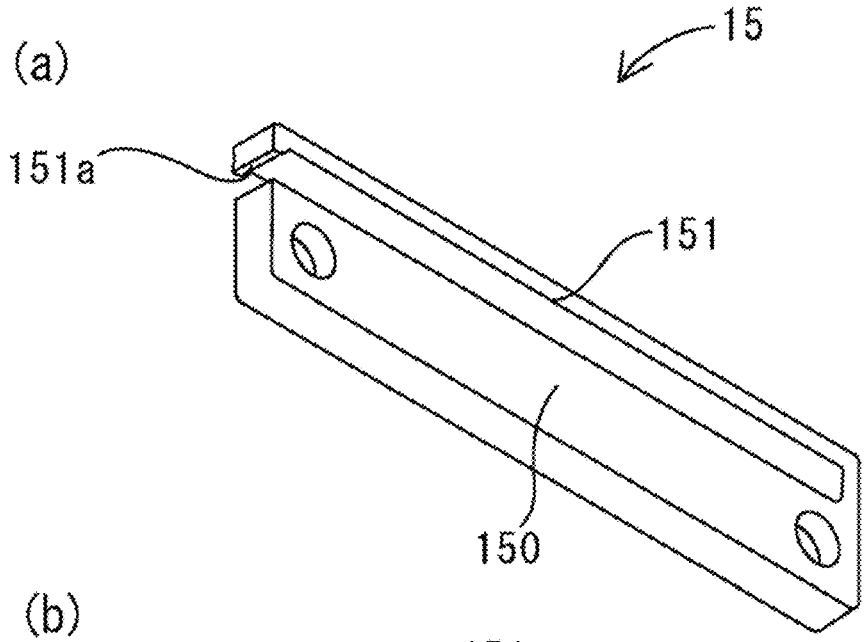
FIG. 9(*a*) is a schematic perspective view of tweezers according to Embodiment 9 as viewed from below, FIG. 9(*b*) is a schematic front view, and FIG. 9(*c*) is a schematic perspective view of the tweezers according to Embodiment 9 as viewed from above.
Figure 9:
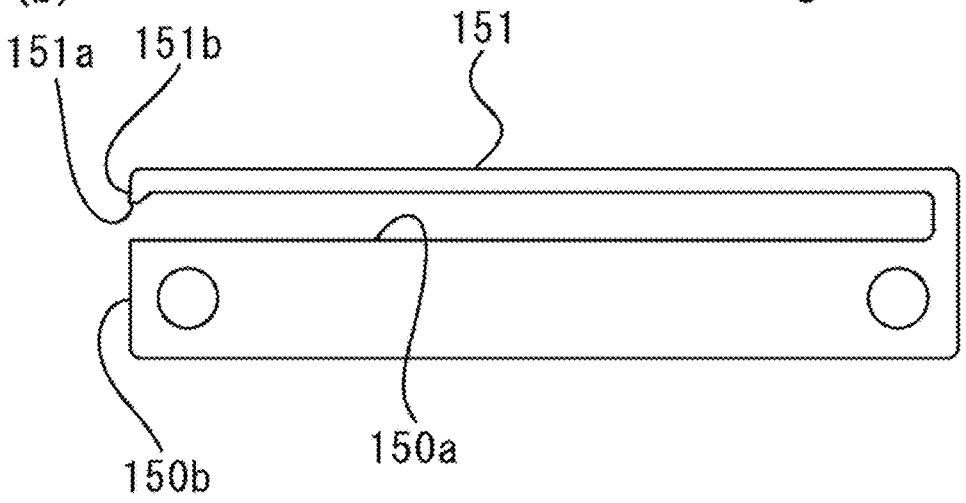
Figure 9:
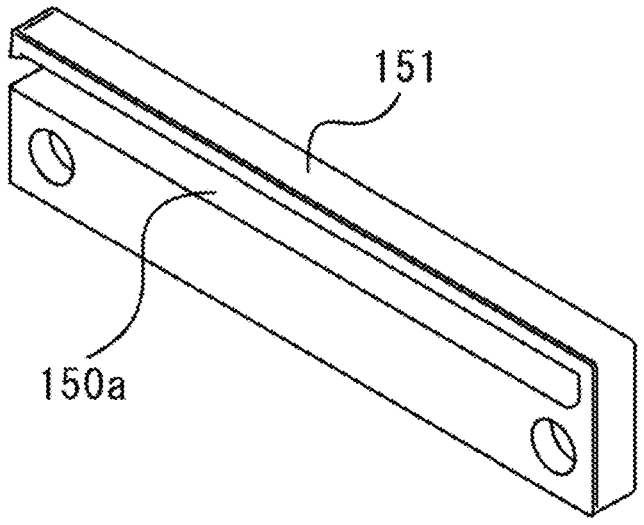

As shown in FIG. 9, tweezers 15 according to Embodiment 9 are used as a key holder having a substantially rectangular shape as a whole and include a main body portion forming one-side gripping section 150 and a movable section forming the other-side gripping section 151 which is connected to a base end of the one-side gripping section 150 and is parallel to the one-side gripping section 150.

The other-side gripping surface 151*a* is formed in a minute surface with respect to a one-side gripping surface 150*a*, so that it is possible to grip a short gripped object. A tip front surface 150*b* and 151*b* of the one-side gripping section 150 and of the other-side gripping section 151, respectively, is formed in a flat plate shape.

Since these operational advantages are as described in Embodiment 8, the explanation will be omitted.

Embodiment 10

Figure 10:
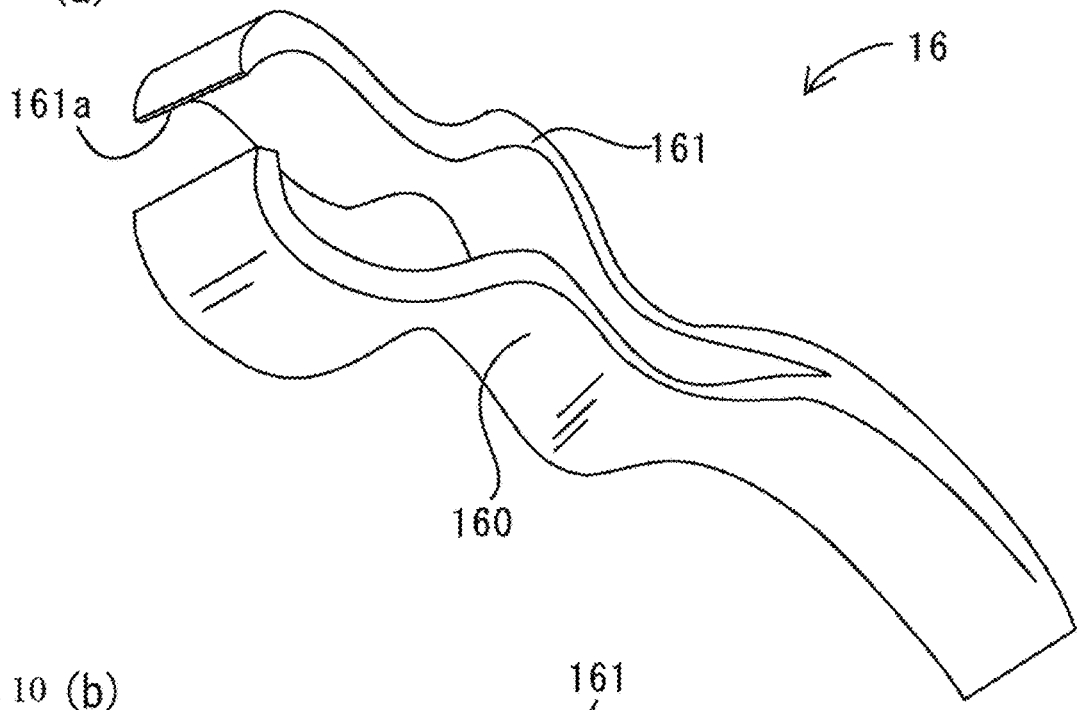
FIG. 10(*a*) is a schematic perspective view of tweezers according to Embodiment 10 as viewed from below, and FIG. 10(*b*) is a schematic front view of the tweezers according to Embodiment 10 and an enlarged view of a tip portion of the tweezers according to Embodiment 10.
Figure 10:
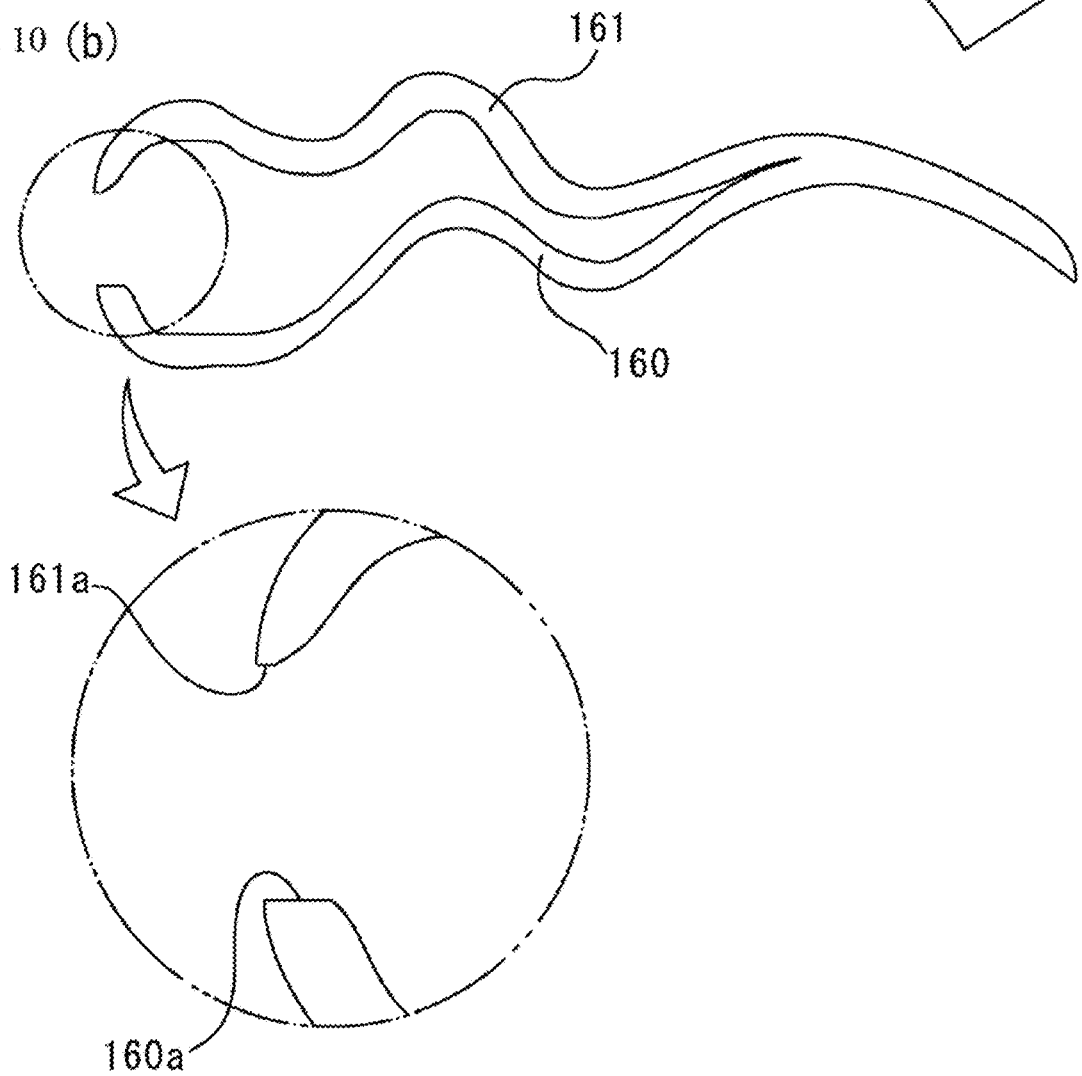

As shown in FIG. 10, tweezers 16 according to Embodiment 10 have an undulating shape as a whole, and a snake is imaged. The tweezers 16 are constituted of a one-side gripping section 160 and the other-side gripping section 161 connected to a base end of the one-side gripping section 160 and extending from the one-side gripping section 150.

The other-side gripping surface 161*a* is formed in a minute surface with respect to a one-side gripping surface 160*a*, so that it is possible to grip a short gripped object. Since these operational advantages are as described in Embodiment 8, the explanation will be omitted.

Embodiment 11

Figure 11:
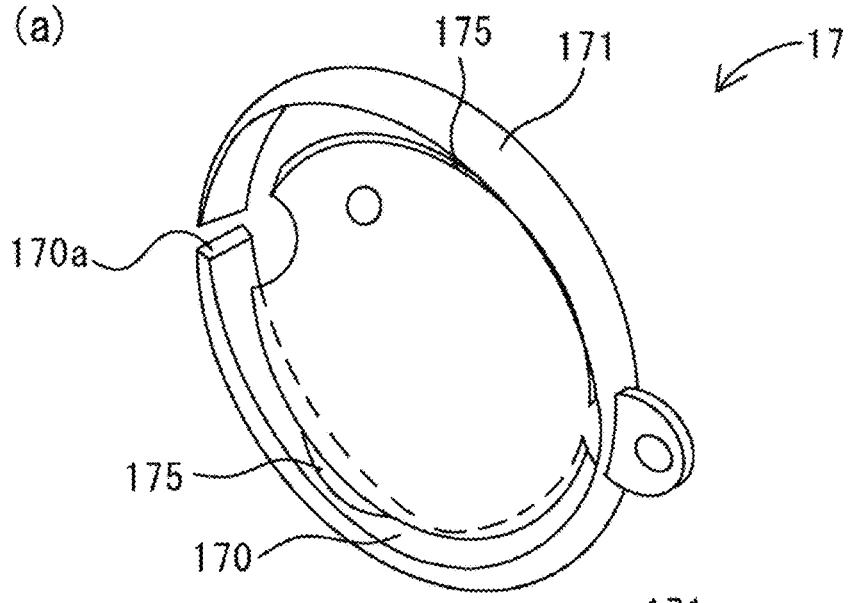
FIG. 11(*a*) is a schematic perspective view of tweezers according to Embodiment 11 as viewed from below, and FIG. 11(*b*) is a schematic front view of the tweezers according to Embodiment 11 and an enlarged view of a tip portion of the tweezers according to Embodiment 11.
Figure 11:
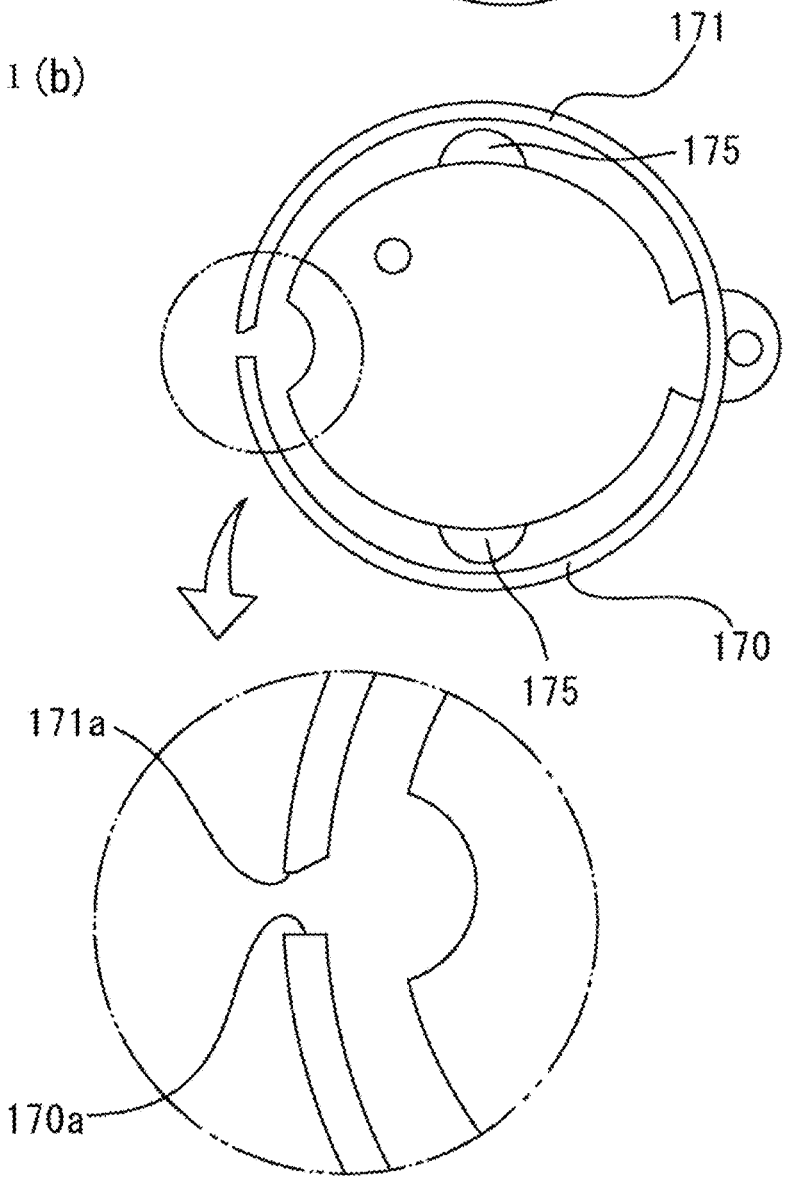

As shown in FIG. 11, tweezers 17 according to Embodiment 11 have a annular shape as a whole and include a disk having a shape like a fish, and a round fish is imaged. The tweezers 17 are constituted of a one-side gripping section 170 and the other-side gripping section 171 connected to a base end of the one-side gripping section 170 and extending from the one-side gripping section 170.

The other-side gripping surface 171*a* is formed in a minute surface with respect to a one-side gripping surface 170*a*, so that it is possible to grip a short gripped object.

An upper portion and a lower portion of the disk are each provided with a projection 175 restricting movement in the gripping direction.

Since these operational advantages are as described in Embodiment 8, the explanation will be omitted.

(Tensile Test)

Test Example 1

Figure 12:
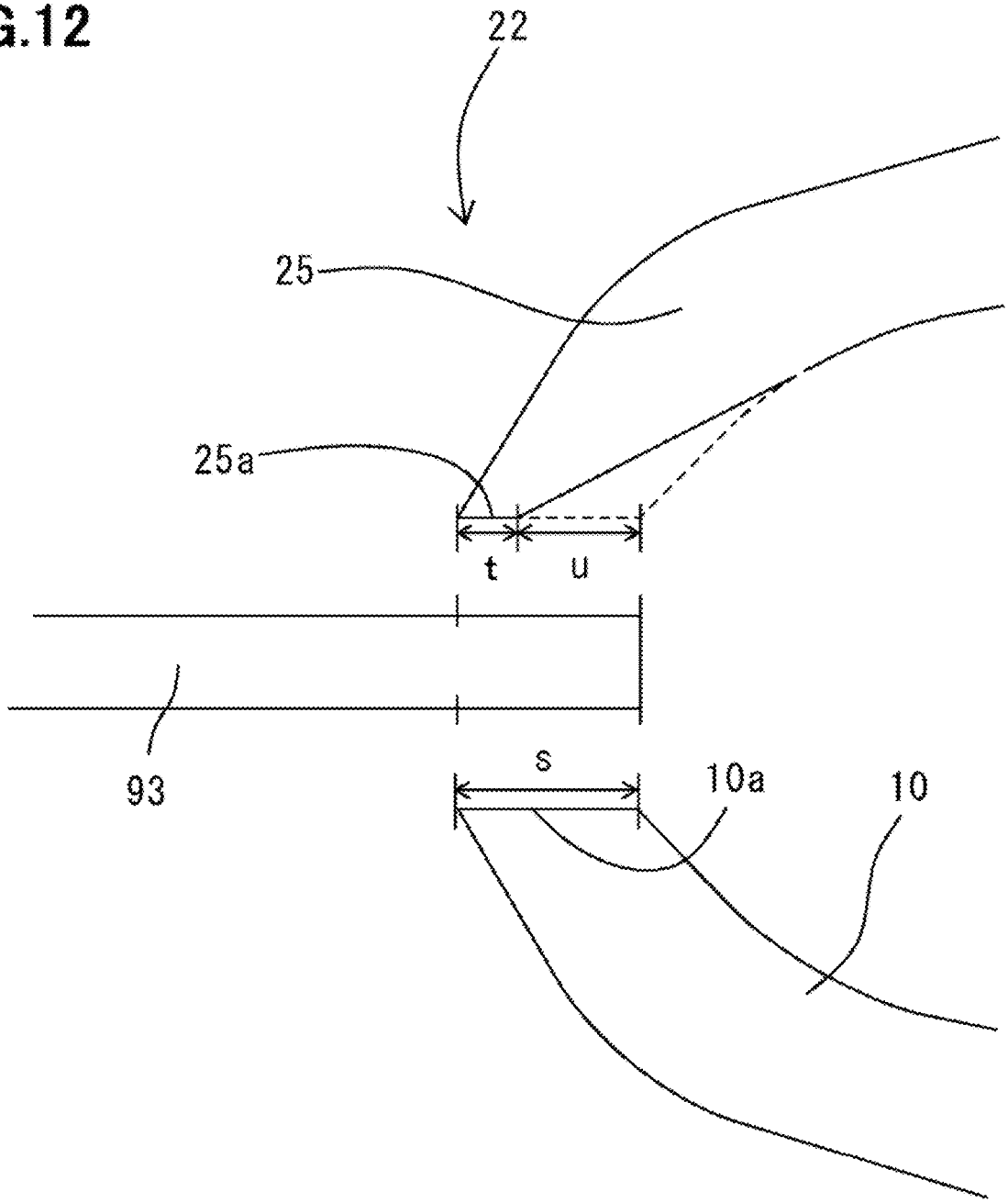
FIG. 12 is a side view showing a state in which a test thread is gripped by using tweezers according to Product 1.

As Product 1 for test, tweezers 22 shown in FIG. 12 were prepared.

The tweezers 22 have a substantially bilaterally symmetrical V shape as a whole and include a pair of resilient gripping sections 10 and 25 on the tip side. A one-side gripping surface 10*a* is a plane, and the other-side gripping surface 25*a* is a reduction plane formed by cutting out a rear end side of opposing plane symmetrically formed in the plane.

The tweezers 22 were produced as Product 1 by processing Kenuki 2 (commodity name) (manufactured by Seria Co., Ltd.) (length in the width direction of the one-side gripping surface 10*a*: about 2 mm, length in the tip direction: about 0.9 mm).

That is, processing was performed such that t:s=1:3 when the length in the width direction of a tip-side imaginary plane is u and the length of the other-side gripping surface 25*a* is t.

As tweezers 28 pertaining to Comparative Product 1, a product before processing of Product 1 described above was prepared.

(1) Test Method

Figure 13:
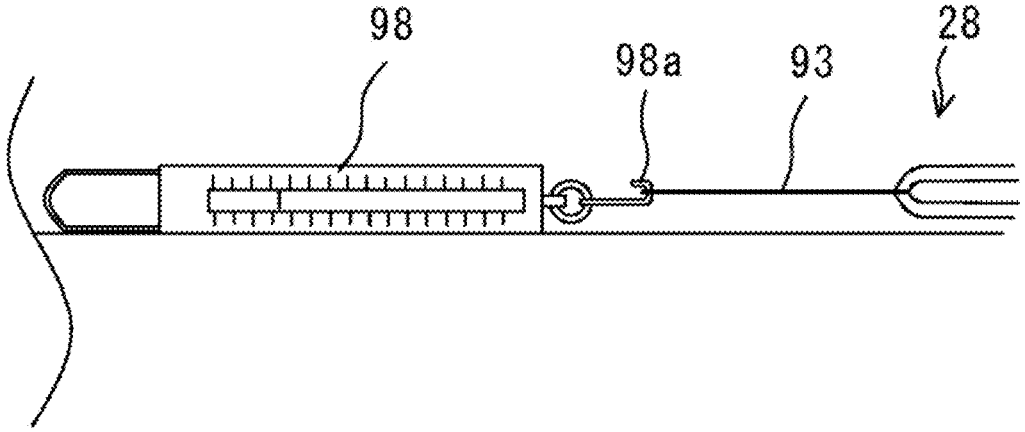
FIG. 13 is a schematic diagram showing a state in which a gripping force is tested by using the tweezers according to Product 1.
Figure 14:
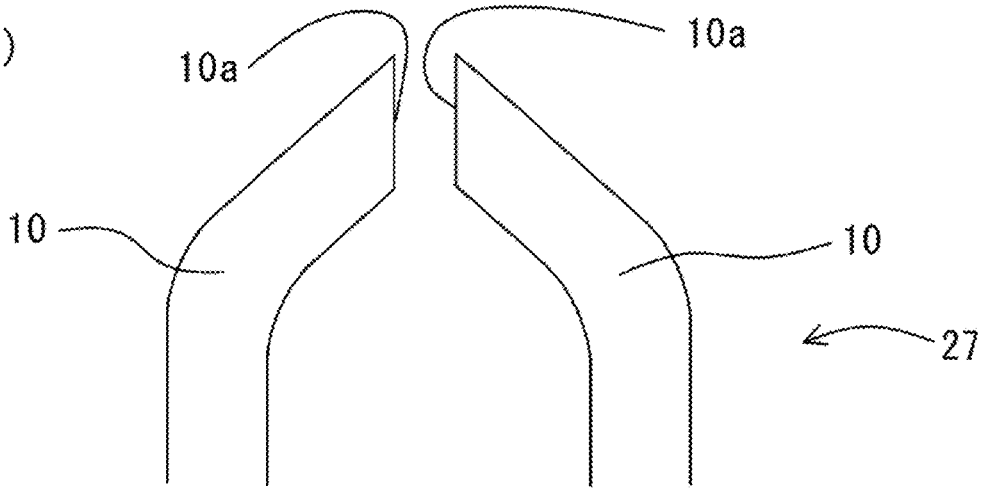
FIG. 14 is a front view showing a tip portion of conventional tweezers, in which FIG. 14(*a*) shows a state in which gripping is not performed, FIG. 14(*b*) shows a state in which gripping sections are lightly brought into contact with each other, and FIG. 14(*c*) shows a state in which the gripping sections are strongly gripped and the tip is opened by bending.
Figure 14:
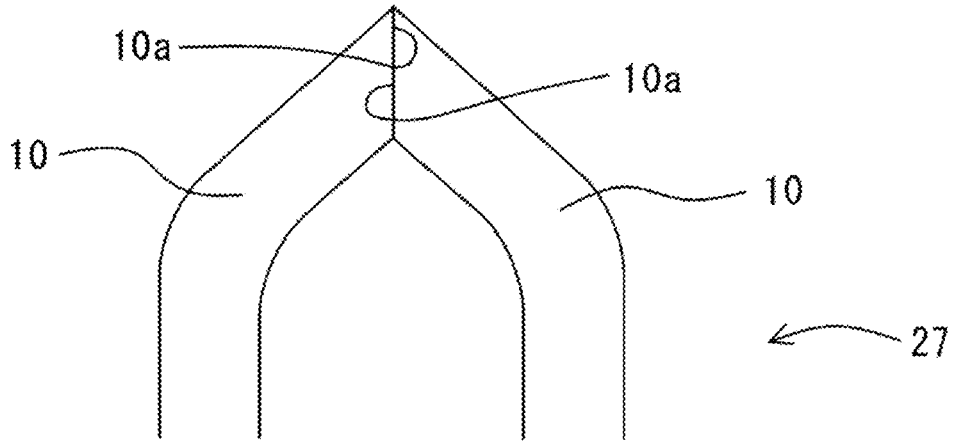
Figure 14:
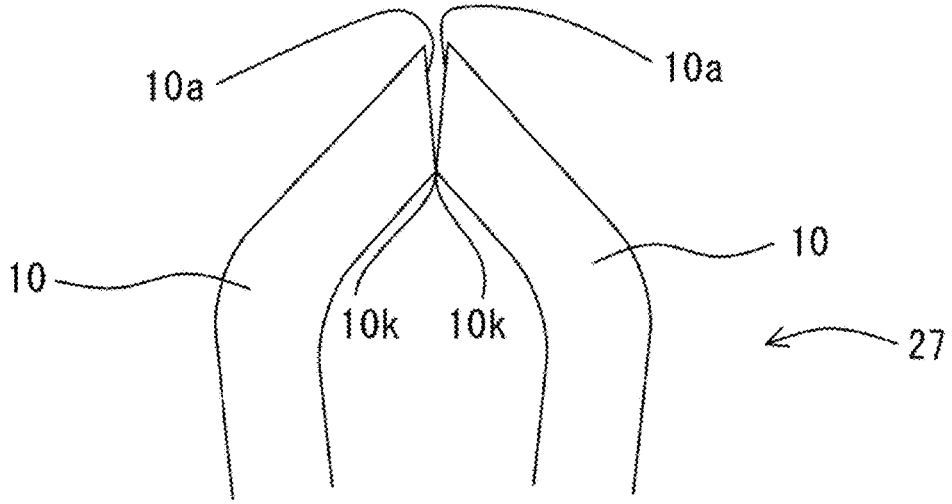
Figure 15:
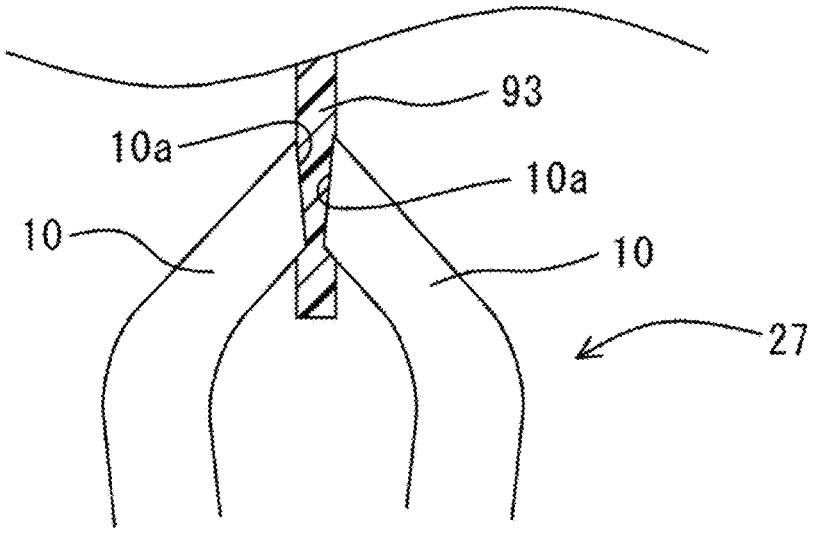
FIG. 15(*a*) is a front view showing a state in which a long thread protruding from a gripping surface is gripped using the conventional tweezers, FIG. 15(*b*) is a front view showing a state in which a thread having the same length as the gripping surface is gripped using the conventional tweezers, and FIG. 15(*c*) is a front view showing a state in which a short hair from the skin is to be gripped using the conventional tweezers.
Figure 15:
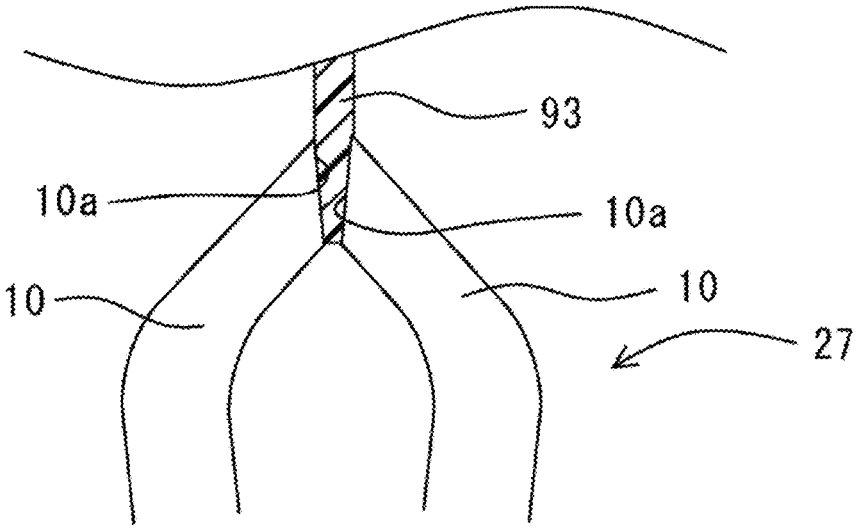
Figure 15:
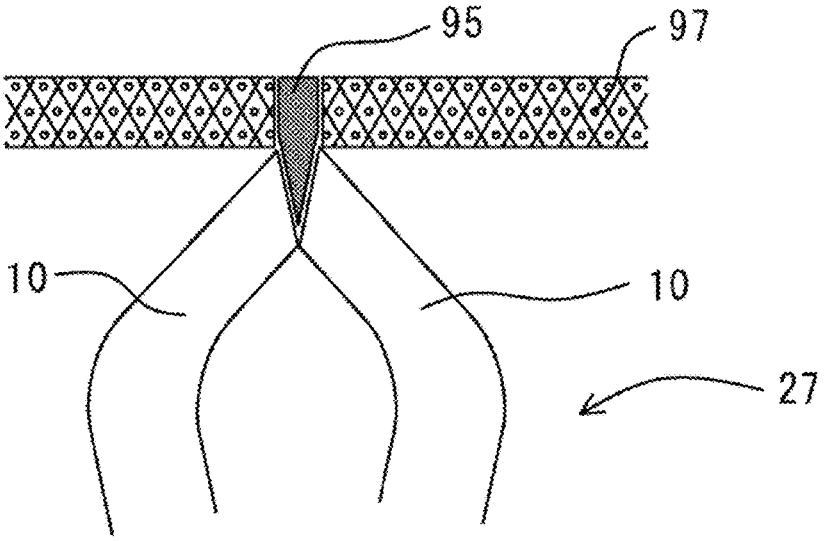
Figure 16:
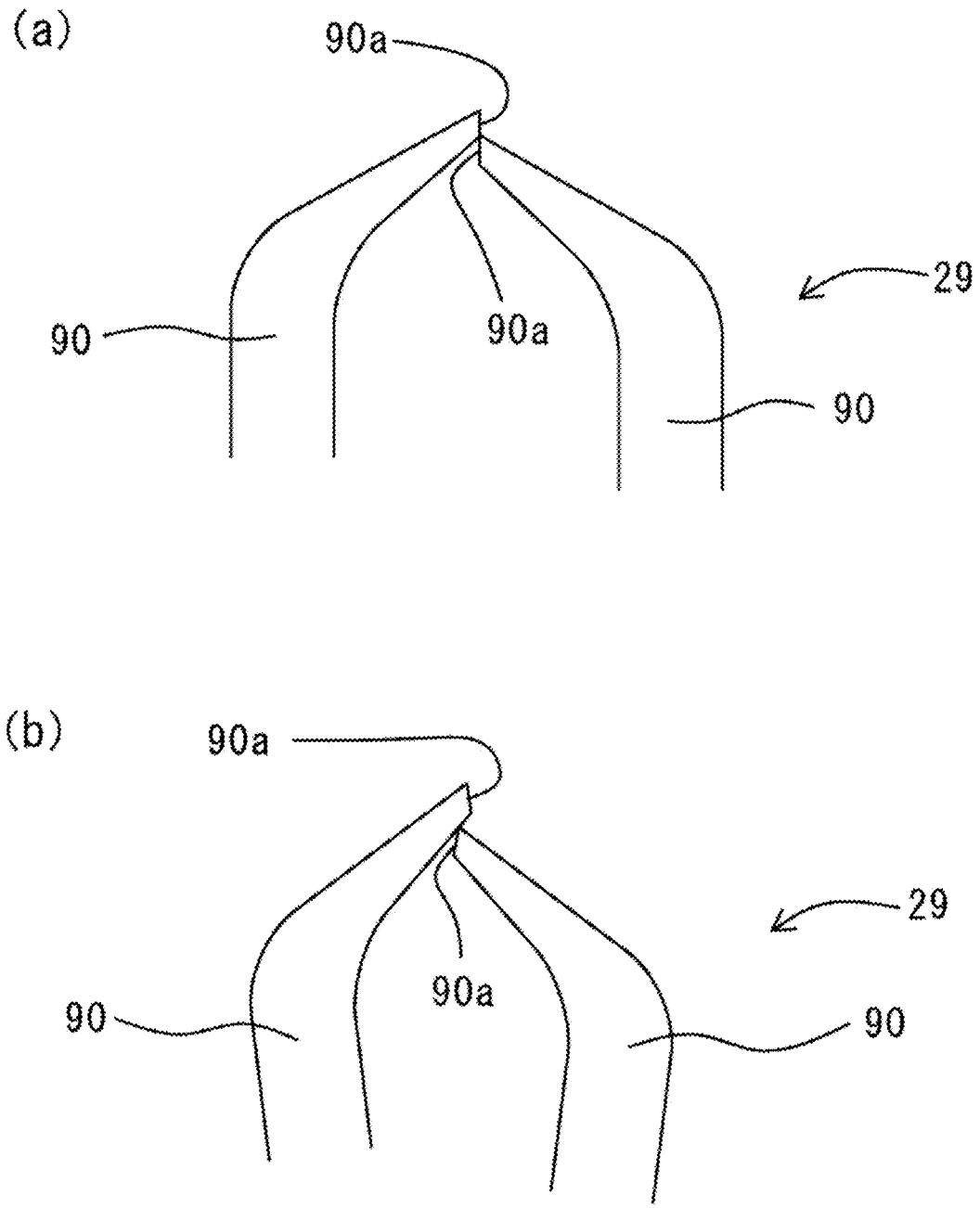
FIG. 16 is a front view of tweezers having small gripping surfaces, FIG. 16(*a*) is a front view showing a state in which the gripping surfaces are likely to be misaligned even with light gripping, and FIG. 16(*b*) is a front view showing an example in which the gripping surfaces are misaligned due to bending caused by strong gripping.

As shown in FIG. 13, a resin thread 93 was hooked on a hook 98*a* of a balance 98 set and fixed on a table, and, as shown in FIG. 12, about 0.9 mm (length s in FIG. 12) from the tip of the thread 93 was gripped by the gripping sections of Product 1 such that the tip of the thread 93 corresponded to the rear end of the gripping surface 10*a* of Product 1. Kureha Chemical No. 4 (diameter: 0.330 mm, fluorocarbon: 100%) was used as the thread 93, and Shinwa Rules Hand Scale 2 kg (product number 74453) was used as the balance 98.

Then, the tweezers were pulled, a moment when the thread 93 was detached from Product 1 was visually measured, and the scale (g) of the balance was taken as the gripping force. After the measurement, the gripped portion was cut each time, and a new thread was drawn out and tested.

The same test was also conducted on Comparative Product 1.

(2) Test Results

TABLE 1

| | The number of times | | | | | | | | | | Average | Ratio to Comparative |
|---|---|---|---|---|---|---|---|---|---|---|---|---|
| | 1 | 2 | 3 | 4 | 5 | 6 | 7 | 8 | 9 | 10 | (g) | Product |
| Comparative Product 1 | 400 | 300 | 400 | 500 | 400 | 400 | 500 | 400 | 300 | 400 | 400 | 100% |
| Product 1 | 500 | 700 | 800 | 500 | 450 | 800 | 500 | 600 | 400 | 500 | 575 | 144% |

As shown in Table 1, it was found out that the gripping force of Product 1 was 44% larger on average than that of Comparative Product 1.

Test Example 2

As in Test Example 1, a tensile test was conducted using Comparative Product 1 and Product 1. Unlike Test Example 1, not less than 1 mm (not less than the length s in FIG. 12) from the tip of the thread 93 shown in FIG. 12 was gripped by gripping sections of Test Product 1 such that the tip of the thread 93 was longer than a rear end of Test Product 1. Other conditions and instruments of the test method were the same as those of Test Example 1.

(2) Test Results

TABLE 3

| | The number of times | | | | | Average | Ratio to Comparative |
|---|---|---|---|---|---|---|---|
| | 1 | 2 | 3 | 4 | 5 | (g) | Product |
| Comparative Product 1 | 700 | 1000 | 900 | 1000 | 1200 | 960 | 100% |
| Product 1 | 1200 | 900 | 1400 | 1000 | 1300 | 1160 | 121% |

As shown in Table 2, it was found out that the gripping force of Product 1 was 21% larger on average than that of Comparative Product 1.

It can be said that the gripping force is larger in Test Example 1. That is, in the tweezers according to the present invention, it was demonstrated that the effect of exerting the gripping force on a short gripped object was particularly large.

Test Example 3

For Test Example 3, tweezers were produced as Product 2 by processing Matsugenuki (commodity name) (manufactured by ECHO KINZOKU) (length in the width direction of the one-side gripping surface 10*a*: about 3 mm, length in the tip direction: about 1 mm) in the same way as Test Product 1. As tweezers pertaining to Comparative Product 2, a product before processing of Product 2 described above was prepared.

As in Test Examples 1 and 2, a tensile test was conducted using Comparative Product 2 and Product 2.

Also in Test Example 3, about 1 mm (length s in FIG. 12) from the tip of the thread 93 was gripped by gripping sections of Test Product 1 such that the tip of the thread 93 corresponded to a rear end of Test Product 2. Other conditions and instruments of the test method were the same as those of Test Example 1.

(2) Test Results

TABLE 3

| | The number of times | | | | | | | | | | Average | Ratio to Comparative |
|---|---|---|---|---|---|---|---|---|---|---|---|---|
| | 1 | 2 | 3 | 4 | 5 | 6 | 7 | 8 | 9 | 10 | (g) | Product |
| Comparative Product 2 | 500 | 600 | 500 | 700 | 500 | 500 | 450 | 650 | 400 | 500 | 530 | 100% |
| Product 2 | 1200 | 1000 | 1000 | 1200 | 1200 | 500 | 1000 | 600 | 900 | 500 | 910 | 172% |

As shown in Table 3, it was found out that the gripping force of Product 2 was 72% larger on average than that of Comparative Product 2.

Even in Test Example 3, in the tweezers according to the present invention, it was demonstrated that the effect of exerting the gripping force on a short gripped object was large.

<Description of Operational Advantages>

Figure 17:
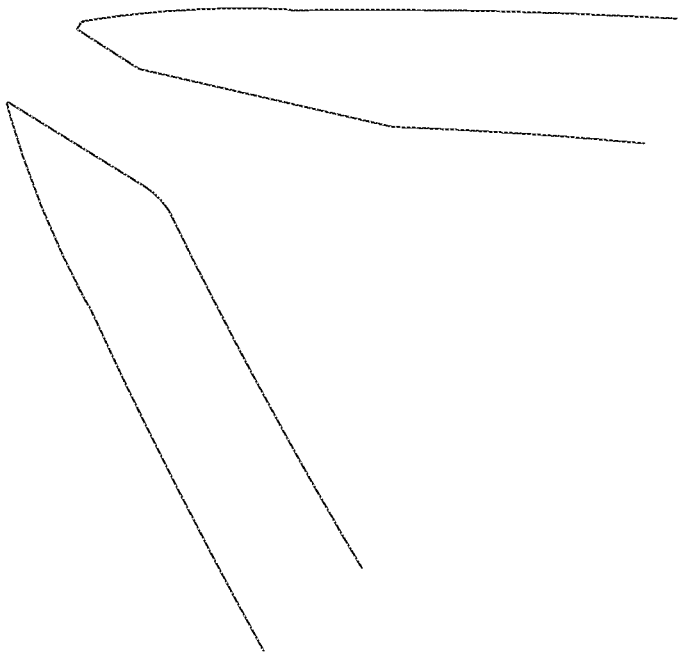
FIG. 17 is a line drawing of Product 2 showing a state before gripping sections are brought into contact with each other.
Figure 18:
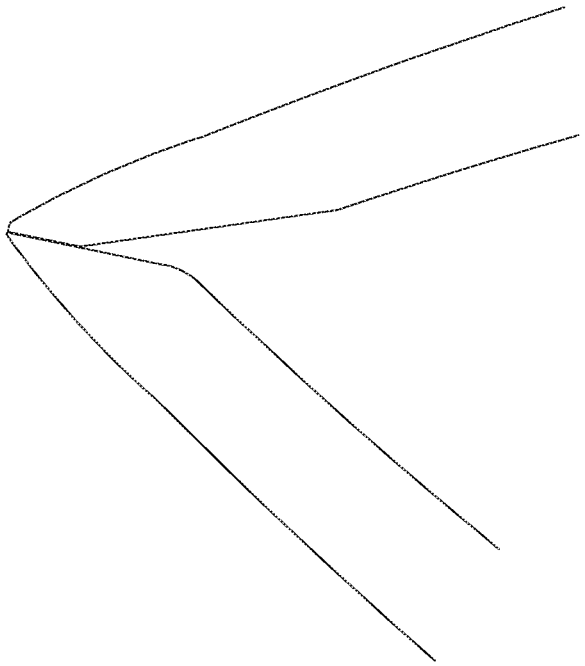
FIG. 18 is a line drawing of Product 2 showing a state in which the gripping sections are lightly brought into contact with each other.
Figure 19:
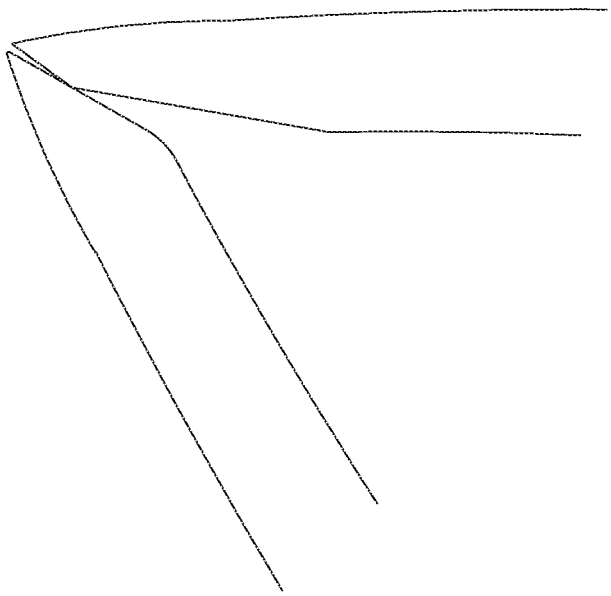
FIG. 19 is a line drawing of Product 2 showing a state in which the gripping sections are strongly gripped.
Figure 20:
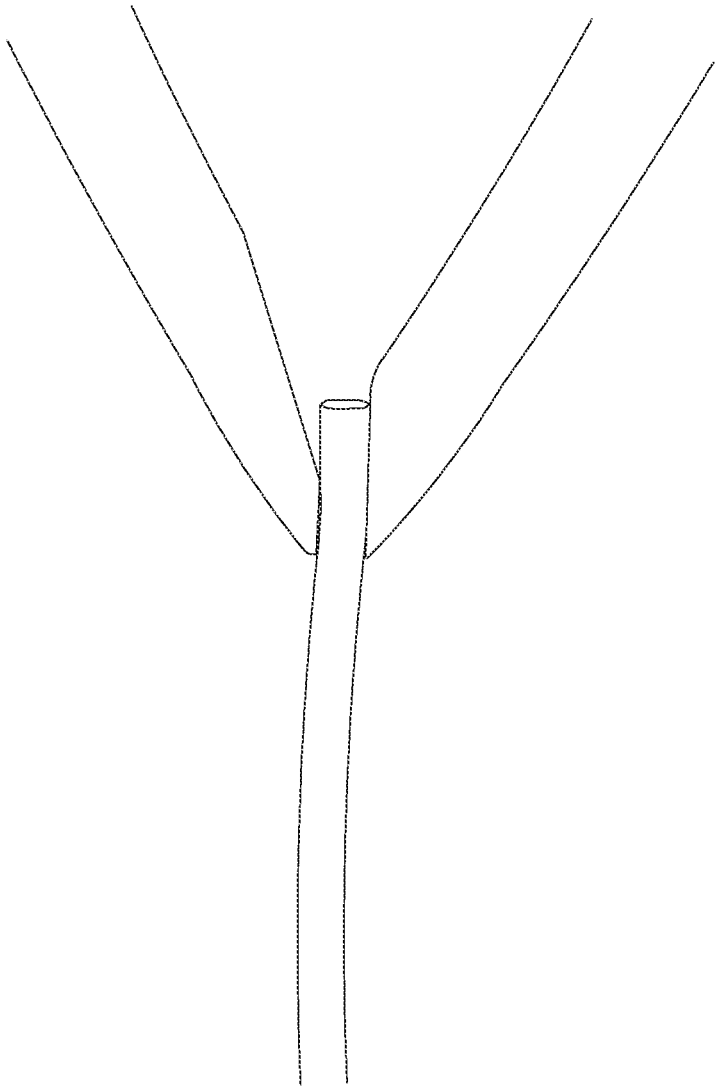
FIG. 20 is a line drawing of Product 2 showing a state in which a thread is lightly gripped.
Figure 21:
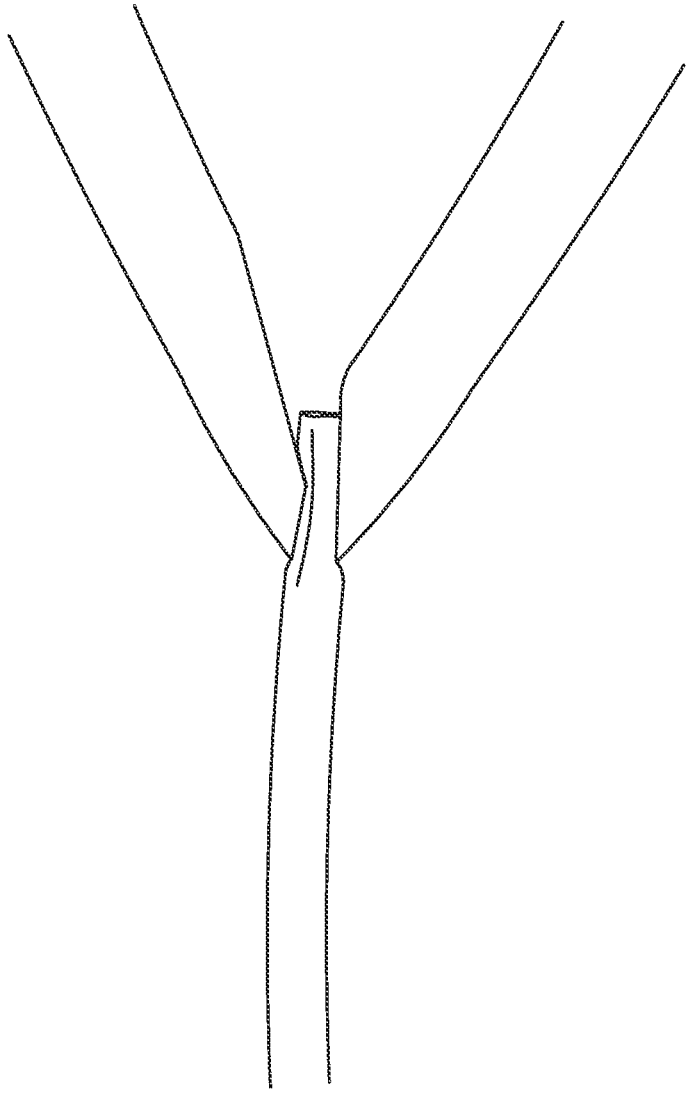
FIG. 21 is a line drawing of Product 2 showing a state in which the thread is strongly gripped.

The operational advantages of Product 2 according to Test Example 3 and Comparative Product 2 will be described. FIGS. 17 to 21 are explanatory views of Product 2, FIG. 17 shows a state before gripping sections are brought into contact with each other, FIG. 18 shows a state in which the gripping sections are brought into light contact with each other, and FIG. 19 shows a state in which the gripping sections are strongly gripped and bent. As shown in FIG. 19, even if the gripping sections are strongly gripped, the tips of the gripping sections come into contact with each other, and the tips are not opened. FIG. 20 shows a state in which a thread is lightly gripped, and FIG. 21 shows a state in which the thread is strongly gripped. Thus, it is found that even a short thread can be reliably gripped at the tip.

Figure 22:
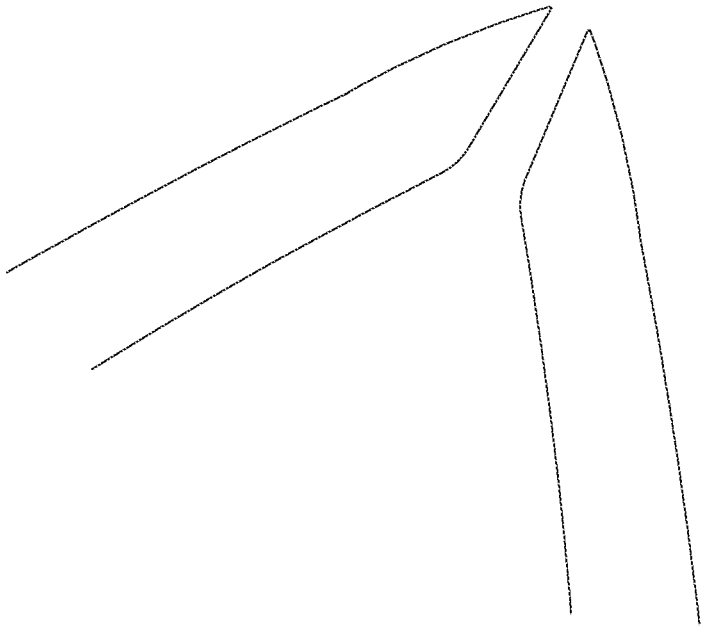
FIG. 22 is a line drawing of Comparative Product 2 showing a state before gripping sections are brought into contact with each other.
Figure 23:
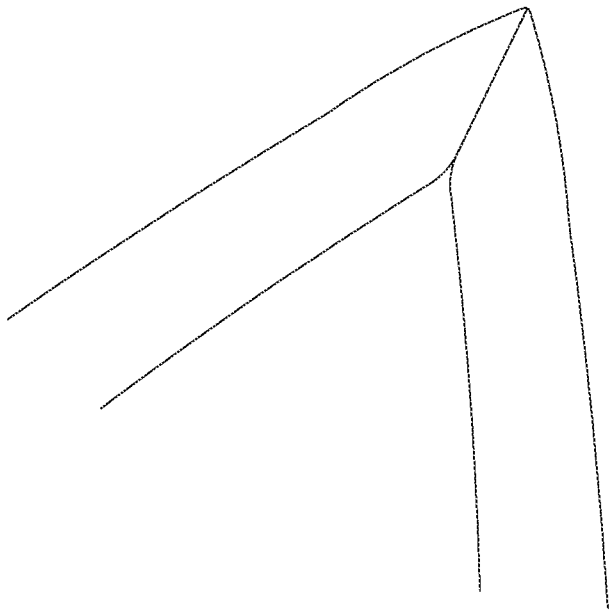
FIG. 23 is a line drawing of Comparative Product 2 showing a state in which the gripping sections are lightly brought into contact with each other.
Figure 24:
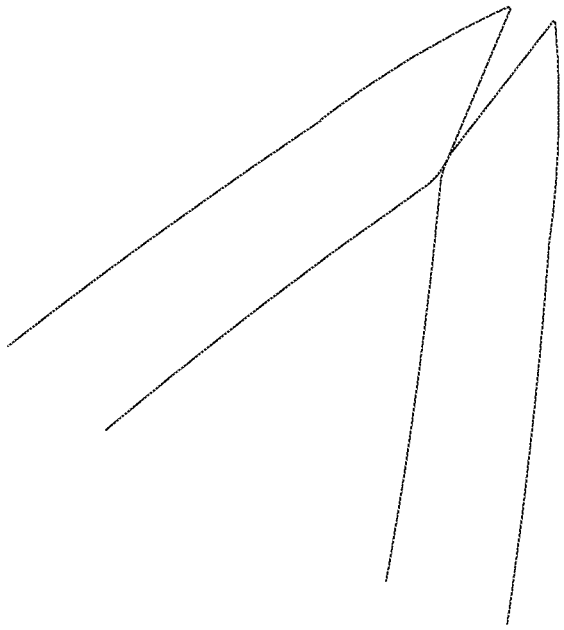
FIG. 24 is a line drawing of Comparative Product 2 showing a state in which the gripping sections are strongly gripped.
Figure 25:
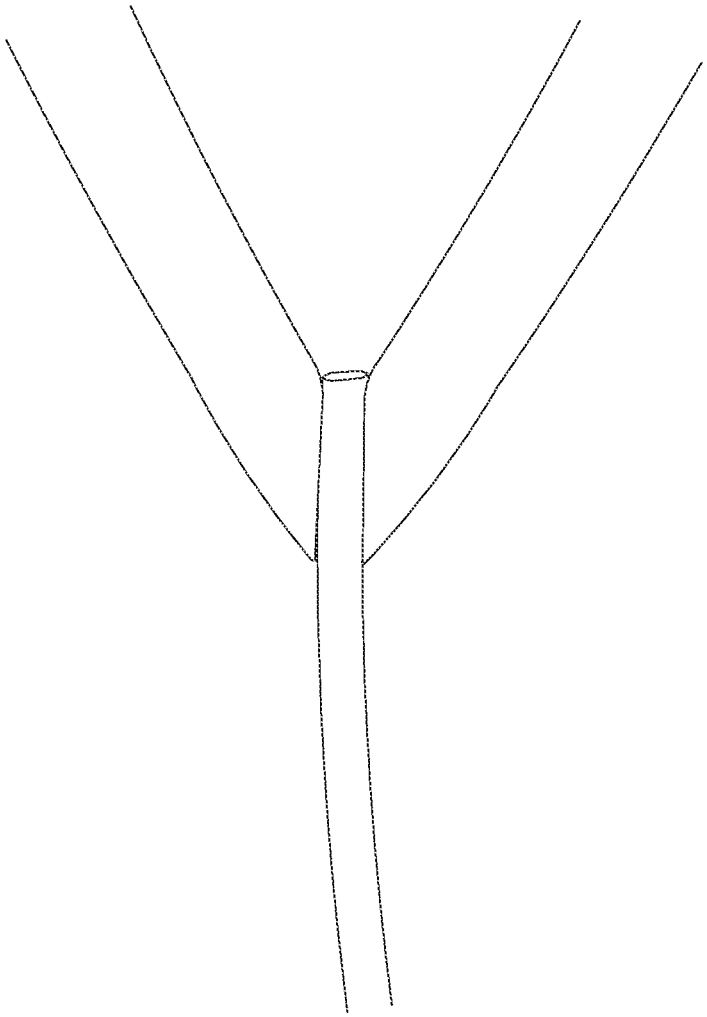
FIG. 25 is a line drawing of Comparative Product 2 showing a state in which a thread is lightly gripped.
Figure 26:
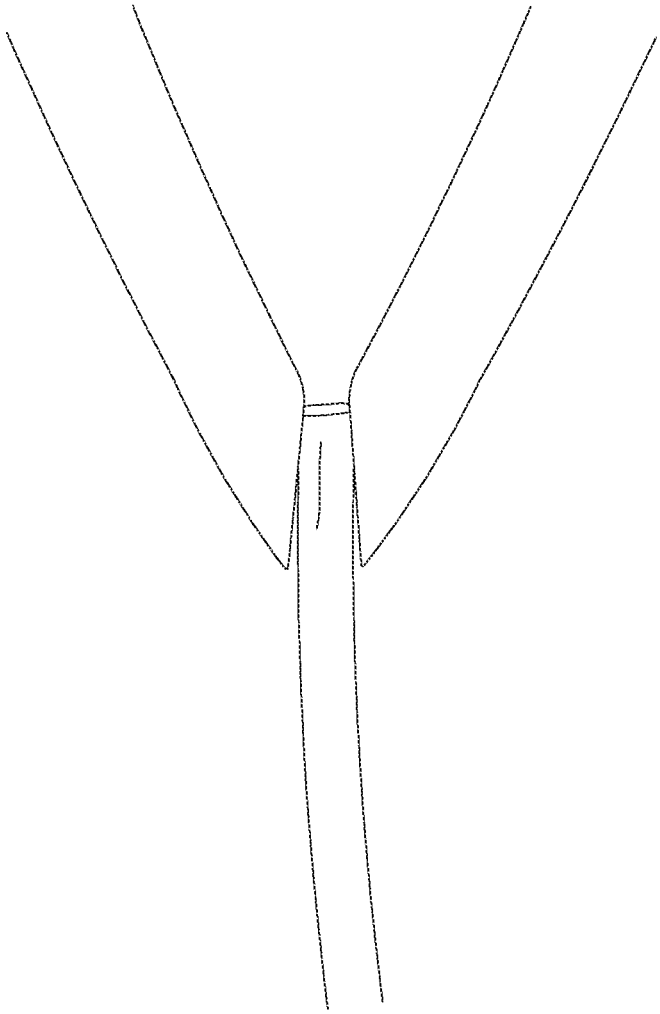
FIG. 26 is a line drawing of Comparative Product 2 showing a state in which the thread is strongly gripped.

FIGS. 22 to 26 are explanatory views of Comparative Product 2, FIG. 22 shows a state before gripping sections are brought into contact with each other, FIG. 23 shows a state in which the gripping sections are brought into light contact with each other, and FIG. 24 shows a state in which the gripping sections are strongly gripped and bent. As shown in FIG. 24, if the gripping sections are strongly gripped, the tip portions of the gripping sections are opened. FIG. 25 shows a state in which a thread is lightly gripped, and FIG. 26 shows a state in which the thread is strongly gripped. It is found that, even if the thread is gripped over the entire gripping surface in the state in which the thread is thus lightly gripped, the tip portion slightly opens, and when the thread is strongly gripped, the tip portion opens widely, so that the gripping force becomes weak.

Further, the operational advantages of Product 3 will be described. Product 3 was produced as Product 3 by processing Matsugenuki (commodity name) (manufactured by ECHO KINZOKU) (length in the width direction of the one-side gripping surface 10*a*: about 3 mm, length in the tip direction: about 1 mm) in the same way as Product 1.

Figure 27:
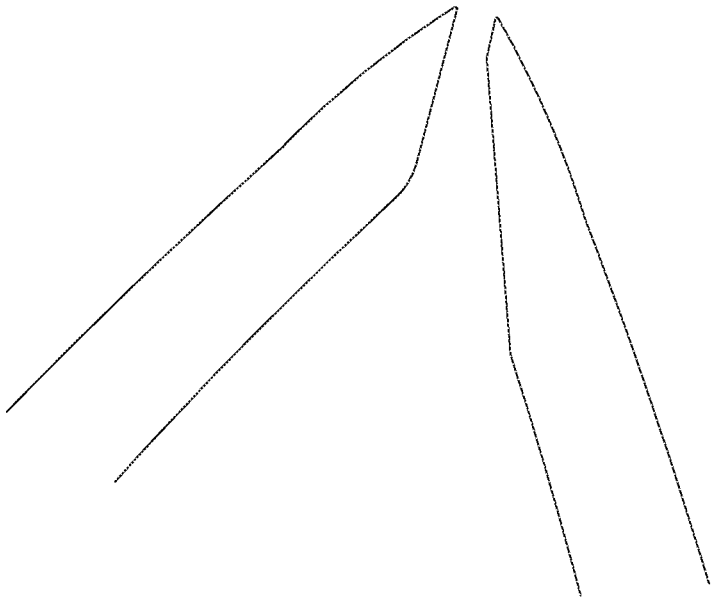
FIG. 27 is a line drawing of Product 3 showing a state before gripping sections are brought into contact with each other.
Figure 28:
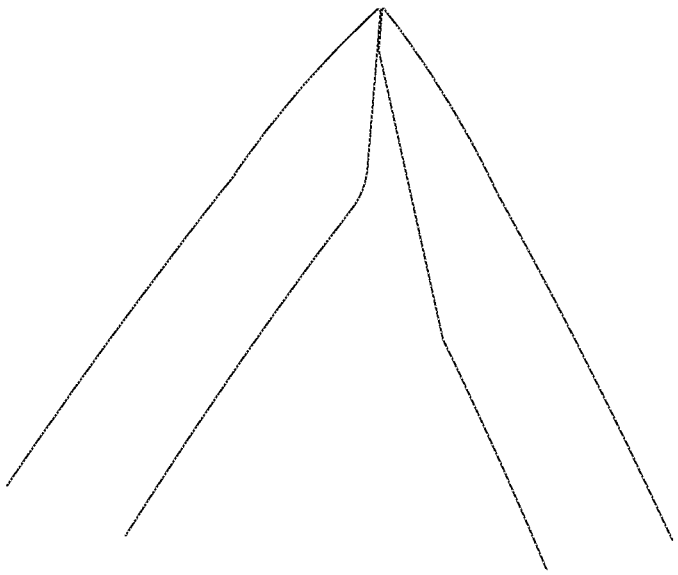
FIG. 28 is a line drawing of Product 3 showing a state in which the gripping sections are lightly brought into contact with each other.
Figure 29:
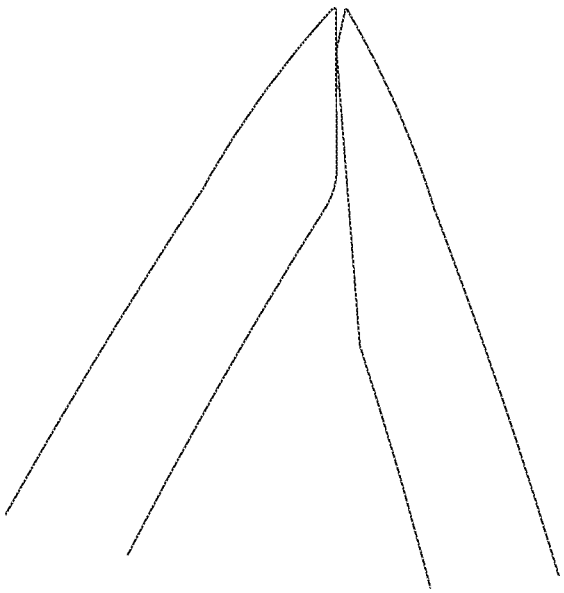
FIG. 29 is a line drawing of Product 3 showing a state in which the gripping sections are strongly gripped.
Figure 30:
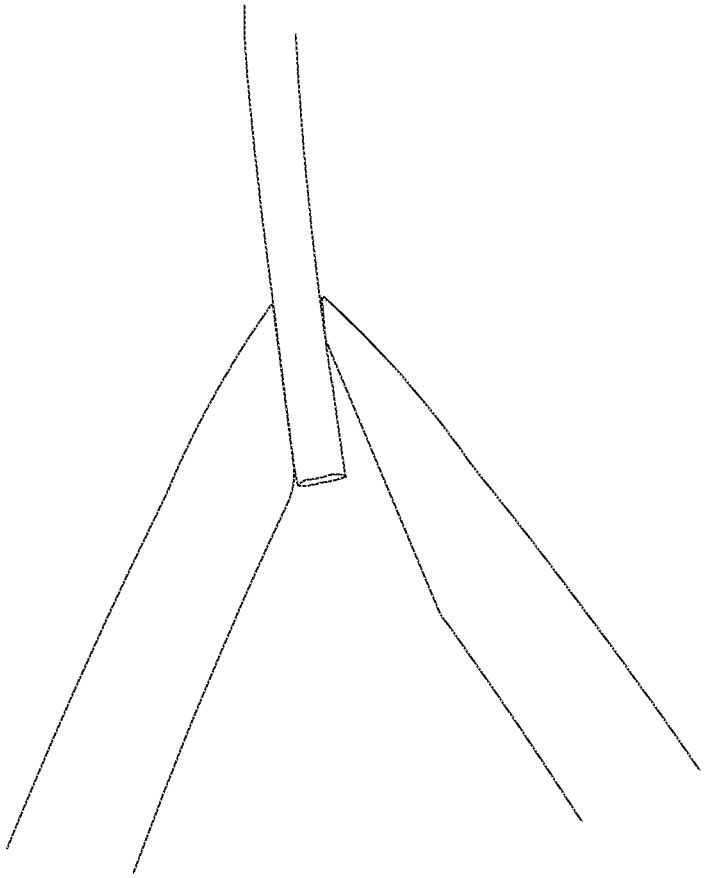
FIG. 30 is a line drawing of Product 3 showing a state in which a thread is lightly gripped.
Figure 31:
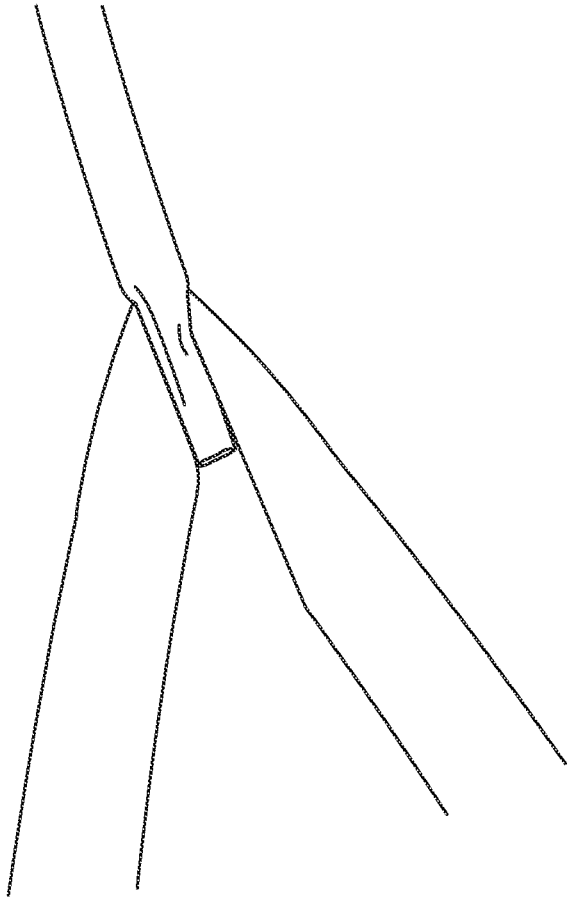
FIG. 31 is a line drawing of Product 3 showing a state in which the thread is strongly gripped.

FIGS. 27 to 31 are explanatory views of Product 3, FIG. 27 shows a state before gripping sections are brought into contact with each other, FIG. 28 shows a state in which the gripping sections are brought into light contact with each other, and FIG. 29 shows a state in which the gripping sections are strongly gripped and bent. As shown in FIG. 29, even if the gripping sections are strongly gripped, the tips of the gripping sections come into contact with each other, and the tips are not opened. FIG. 30 shows a state in which a thread is lightly gripped, and FIG. 31 shows a state in which the thread is strongly gripped. Thus, it is found that even a short thread can be reliably gripped at the tip.

1, 2, 3, 4, 5, 6, 7, 8, 15, 16, 17, 22, 27, 28, 29: Tweezers
10, 11, 18, 19, 20, 21, 25, 30, 40: Gripping section
80, 150, 160, 170: One-side gripping section
81, 151, 161, 171: The other-side gripping section
10*a*, 15*a*, 16*a* 17*a*, 80*a*, 150*a*, 160*a*, 170*a*: One-side gripping surface
11*a*, 20*a*, 25*a*, 81*a*, 151*a*, 161*a*, 171*a*: The other-side gripping surface
11*h*, 20*h*, 30*h*: Protrusion
80*b*, 81*b*: Tip front surface
80*c*: Recess
81*c*: Engaging recess
85, 175: Projection
93, 95: Gripped object

The invention claimed is:

1. Tweezers having elasticity, comprising:

a one-side gripping section at a tip side of the tweezers, the one-side gripping section having a one-side gripping surface; and an other-side gripping section at the tip side of the tweezers, the other-side gripping section having an other-side gripping surface, wherein a tip end of the one-side gripping surface is in the same position as a tip end of the other-side gripping surface, each of the one-side gripping surface and the other-side gripping surface is flat, a rear end of the other-side gripping surface is located closer to the tip side of the tweezers than a rear end of the one-side gripping surface, and the one-side gripping surface and the other-side gripping surface are configured to grip a gripped object therebetween.

2. Tweezers having elasticity according to claim 1, wherein the other-side gripping surface is a reduction plane that is formed by removing a rear end side of a plane-symmetrical shape that is plane-symmetrical to the plane of the one-side gripping surface.

3. The tweezers according to claim 1, wherein the other-side gripping surface has a length in a tip direction of 0.1 mm to 1 mm.

4. The tweezers according to claim 1, which are hair tweezers, thorn tweezers, or fishbone tweezers.

* * * * *